US006475685B2

(12) United States Patent
Uchida et al.

(10) Patent No.: US 6,475,685 B2
(45) Date of Patent: Nov. 5, 2002

(54) ELECTROSTATICALLY CHARGED IMAGE DEVELOPING TONER, PRODUCTION METHOD OF THE SAME, AND AN IMAGE FORMING METHOD

(75) Inventors: Masafumi Uchida, Hachioji (JP); Tsuyoshi Uchida, Hachioji (JP); Mikio Kohyama, Hino (JP); Kenji Hayashi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/793,756

(22) Filed: Feb. 26, 2001

(65) Prior Publication Data

US 2001/0026899 A1 Oct. 4, 2001

(30) Foreign Application Priority Data

Feb. 28, 2000 (JP) ..... 2000-051787

(51) Int. Cl.[7] ..... G03G 9/087

(52) U.S. Cl. ..... 430/99; 430/108.4; 430/109.4; 430/111.4

(58) Field of Search ..... 430/109.2, 109.1, 430/108.1, 111.1, 108.4, 137.14, 137.17, 99

(56) References Cited

U.S. PATENT DOCUMENTS 4,778,899 A * 10/1988 Pfenninger et al. ..... 548/453
5,876,492 A * 3/1999 Malhotra et al. ..... 106/31.58

* cited by examiner

*Primary Examiner*—John Goodrow
(74) *Attorney, Agent, or Firm*—Bierman, Muserlian and Lucas

(57) ABSTRACT

A toner for developing electrostatic latent image is disclosed. The toner comprises a crystalline compound, and exhibits at least one recrystallization peak during the second heating process in the DSC curve of said toner. An image forming method employing the toner is also disclosed.

16 Claims, 1 Drawing Sheet

ELECTROSTATICALLY CHARGED IMAGE DEVELOPING TONER, PRODUCTION METHOD OF THE SAME, AND AN IMAGE FORMING METHOD

FIELD OF THE INVENTION

The present invention relates to a toner for developing electrostatically charged images, which can provide excellent damage resistance to the formed images, a production method of the same, and an image forming method.

BACKGROUND OF THE INVENTION

Employed as the quality performance standards of fixed images id "fixed strength" as well as "fixability". In such evaluation, noted are the adhesion force of fixed images on the image support (for example, recording paper), the destruction of fixed images, and the transference of destroyed materials to the fixing member and the like.

In recent years, higher image quality in printers and the like has been demanded. As a result, the presence and absence of damage on the surface of fixed images, especially photographic images, have become an important standard to evaluate said images.

For example, the quality of photographic images (black-and-white images as well as full color images) is markedly deteriorated due to the presence of abrasion caused by friction between recording papers, and scratches as well as dents caused by nails, stationery, and the like. Subsequently, demanded has been development of a technique for forming excellent damage resistant fixed images which are barely subjected to surface damage.

SUMMARY OF THE INVENTION

In view of the foregoing, the present invention has been achieved.

An object of the present invention is to provide a toner for developing electrostatically charged images, which can provide excellent damage resistance (that is, abrasion resistance, scratch resistance, and dent resistance).

Another object of the present invention is to provide a toner producing method which can form excellent damage resistant fixed images.

Still another object of the present invention is to provide an image forming method which can form excellent damage resistant fixed images.

It has been discovered that by utilizing a toner which comprises crystalline compounds having a specified chemical structure in an specified amount and exhibits specific thermal behavior during melting of crystals as well as during crystallization, it is possible to form high quality fixed images having the desired damage resistance.

The electrostatically charged image developing toner of the present invention comprises at least a binder resin and a colorant; also comprises crystalline compounds (hereinafter referred occasionally to as "specified crystalline compounds") represented by General Formula (1) in an amount of 3 to 40 parts by weight per 100 parts by weight of said binder resins; and exhibits at least one recrystallization peak during the second heating process in the DSC (hereinafter referred to as DSC) curve of said toner, which is determined by employing a DSC.

One of the preferred examples of the electrostatically charged image developing toner of the present invention is comprised of particles which are obtained by direct polymerization of a monomer composition comprising said specified crystalline compounds and polymerizable monomers in a water phase.

Further, another example of said toner is comprised of particles which are obtained by coalescing fine particles obtained by directly polymerizing a monomer composition comprising said specified crystalline compounds and polymerizable monomers in a water phase.

In a production method of an electrostatically charged image developing toner in which at least a binder resin, a colorant, and a crystalline compound, represented by General Formula (1) are dry mixed, melt kneaded employing a kneader, pulverized, and if desired, classified, the toner production method of the present invention comprises a process which exhibits the maximum temperature during melt kneading which is higher than melting peak temperature $t_{1m}$ (in ° C.) of said crystalline compounds during the first heating process determined by a DSC and cools toner raw materials ejected from said kneader at a cooling rate of 1 to 20° C./second to the specified temperature which is below ($t_{1m}$−30° C.).

Further, another toner production method of the present invention is an electrostatically charged image developing toner production method in which an electrostatically charged image developing toner, comprising at least a binder resin, a colorant, and a crystalline compound, represented by the general formula described below, is produced employing a polymerization method, and the maximum temperature during production is no less than melting peak temperature $t_{1m}$ (in ° C.) of said crystalline compound during the first heating process which is determined employing a DSC, and which comprises a process which cools toner raw materials from said maximum temperature to not more than ($t_{1m}$−30° C.) at a cooling rate of 1 to 20° C./minute.

The image forming method of the present invention is one which comprises processes in which an electrostatically charged image formed on an electrostatic image bearing body is developed employing a toner; a toner image formed on said electrostatic image bearing body is transferred onto an image support and the transferred toner image is heated and pressure fixed employing a heating roller, by which fixed images are obtained. Said toner comprises at least a binder resin, a colorant, and a specified crystalline compound, and said crystalline compound exhibits at least one recrystallization peak during the second heating process in the DSC curve of said specific crystalline compound, which is determined employing a DSC.

Furthermore, the image forming method of the present invention is one which comprises processes in which an electrostatically charged image formed on an electrostatic image bearing body is developed employing a toner; the resultant toner image formed on said electrostatic image bearing body is transferred onto an image support; and the transferred toner image is thermally pressure fixed employing a heating roller, by which fixed images are obtained.

Said toner comprises at least a binder resin, a colorant, and a specified crystalline compound, and said crystalline compound exhibits at least one recrystallization peak during the second heating process in the DSC curve of said specified crystalline compound, which is determined employing a DSC. The surface temperature of said heating roll is the same as said recrystallization peak temperature $t_{rc}$ or higher, and the surface temperature of said image support 3 seconds after passing the fixing nip roll is at least 90° C. lower than the surface temperature of said heating roll.

General Formula (1):

$$R^1—(OCO—R^2)_n$$

wherein $R^1$ represents a hydrocarbon group having from 1 to 80 carbon atoms, which may have a substituent, or a group represented by formula of $(LK_1—X—LK_2)_m—$, wherein $LK_1$ and $LK_2$ represent a hydrocarbon group, which may have a substituent, and $LK_1$ and $LK_2$ may be same or different, m is a natural number of 1 or more, X represents O or —OC—, $R^2$ represents a hydrocarbon group having from 1 to 80 carbon atoms, which may have a substituent, and n represents an integer of 1 to 15.

DETAILED DESCRIPTION OF THE INVENTION

Figure 1:
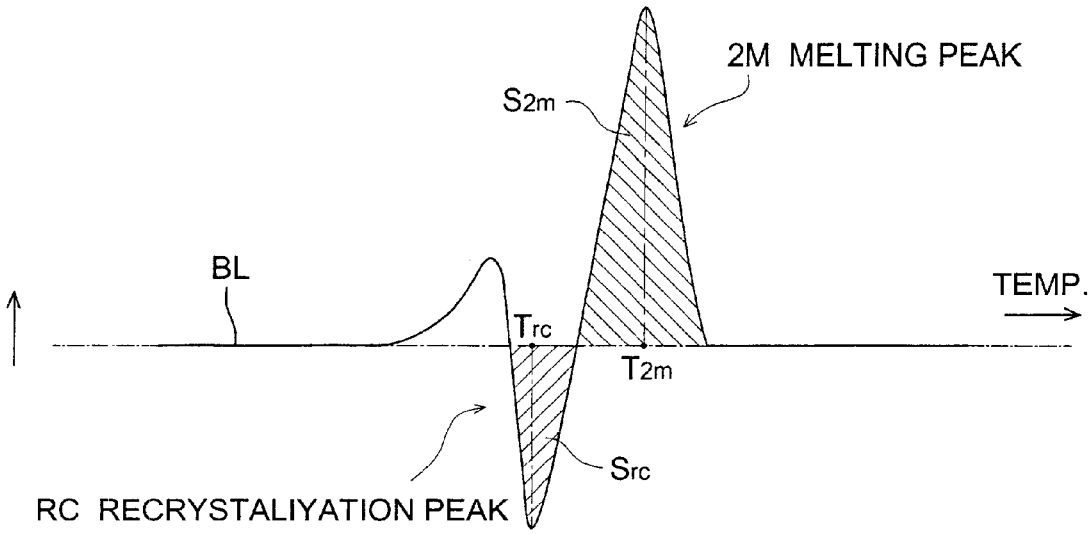
FIG. 1 is a curve diagram showing one example of the DSC curve of a toner during the second heating process.

During fixing of a toner image which is transferred onto an image support while employing the toner of the present invention, a specified crystalline compound which constitutes the toner of the present invention is subjected to blooming (crystallization), and the cover layer (a surface protective layer) comprised of said specified crystalline compound is formed on the surface of the fixed images.

Herein, surface protection effects (damage resistance), which minimize stress, are achieved by a cover layer which is formed by blooming said crystalline compounds, and said effects depend on the structure as well as the dynamical properties of crystals which fabricate said cover layer.

Further, research results obtained by the inventors of the present invention have revealed that the structure, as well as the dynamical properties of crystals which fabricate said cover layer depends on the crystal melting as well as the thermal behavior during crystallization of said crystalline compound.

As can clearly be seen from the results of the examples described below, by forming images employing the toner which comprises specified crystalline compounds in a specified ratio and exhibits specific thermal behavior (behavior due to the incorporation of specific crystalline compounds) so as to have at least one recrystallization peak during the second heating process, which is obtained by employing a DSC, a cover layer comprised of said specified crystalline compound is formed on the surface of the resultant fixed images. Thus, said cover layer can minimizes all kinds of stress, which will be applied to the fixed images (finished images).

Herein, the reason why the damage resistance of the image surface is enhanced depending on the specific thermal behavior due to incorporation of specified crystalline compounds is not yet well understood. However, it is assumed that in the toner of the present invention, which exhibit a specific thermal behavior, the entire cover layer, which is formed employing said crystalline compounds, is not comprised of perfect crystals, but is partially comprised of crystals in a metastable region (thin and thermally unstable crystals), and said crystals in said metastable region contribute markedly to the enhancement of the damage resistance of the surface of fixed images.

The toner of the present invention, which exhibits the specific thermal behavior, can be suitably produced by providing specified thermal history (maximum temperature and cooling rate) to toner raw materials comprising said specified crystalline compounds.

<Measurement Methods and Definitions>

(1) Measurement Method of the DSC Curve

In the present invention, the DSC curves of toners as well as crystalline compounds are determined employing a DSC (DSC). Cited as the specific measurement apparatus can be DSC-7 manufactured by Perkin-Elmer Corp.

Heating and cooling conditions are as follows: after setting the toner aside at 0° C. for one minute, the temperature is increased to 200° C. under the condition of 10° C./minute (being the first heating process); subsequently, after setting said toner aside at 200° C. for one minute, the temperature is decreased to 0° C. at the rate 10° C./minute (being the first cooling process); and subsequently, after setting said toner aside at 0° C. for one minute, the temperature is increased to 200° C. at the rate of 10° C./minute (being the second heating process).

(2) DSC Curve of Toner

In the DSC curve of a toner during the first heating process, a peak temperature on the highest side of existing endothermic peaks is defined as "melting peak temperature $T_{1m}$" (in ° C.)".

In the DSC curve of a toner during the cooling process, a peak on the lowest temperature side of the existing exothermic peaks is defined as "crystallization peak temperature $T_{1c}$" (in ° C.).

In the DSC curve of a toner during the second heating process, the peak temperature on the highest side of existing endothermic peaks is defined as "melting peak temperature $T_{2m}$ in ° C.".

In the DSC curve of a toner during the second heating process, a peak, in the peak area (the area of said peak above the base line) of the existing exothermic peaks, which is at least 5 percent larger than that of the melting peak at said melting peak temperature $T_{2m}$, is defined as the "recrystallization peak", and the peak temperature in the said recrystallization peak area is largest, is defined as "recrystallization peak temperature $T_{rc}$" in ° C.".

(3) DSC Curve of Crystalline Compounds

In the DSC curve of a crystalline compound during the heating process, the peak temperature on the highest temperature side of existing endothermic peaks is defined as "melting peak temperature $T_{1m}$ " in ° C.

In the DSC curve of a crystalline compound during the cooling process, the peak on the lowest temperature side of the existing exothermic peaks is defined as "crystallization peak temperature $T_{1c}$" in ° C.

In the DSC curve of a crystalline compound during the second heating process, the peak temperature on the highest side of existing endothermic peaks is defined as "melting peak temperature $T_{2m}$" in ° C.

In the DSC curve of a crystalline compound during the second heating process, the peak, in the peak area (the area of said peak above the base line) of the existing exothermic peaks, which is at least 5 percent larger than that of the melting peak at said melting peak temperature $T_{2m}$, is defined as "recrystallization peak", and the peak temperature, at which said recrystallization peak area is largest, is defined as "recrystallization peak temperature $T_{rc}$" in ° C.

<Toner>

The toner of the present invention comprises at least a binder resin and a colorant.

One of the features of the toner of the present invention is that specified crystalline compounds (crystalline esters) represented by the aforementioned General Formula (1) are incorporated in an amount of 3 to 40 parts by weight with respect to 100 parts by weight of said binder resin.

<Crystalline Esters>

In General Formula (1) which represents crystalline esters, which constitute the toner of the present invention, wherein $R^1$ represents a hydrocarbon group having from 1 to 80 carbon atoms, which may have a substituent, or a group represented by formula of $(LK_1—X—LK_2)_m—$, wherein $LK_1$ and $LK_2$ represent a hydrocarbon group, which may have a substituent, and $LK_1$ and $LK_2$ may be same or different, m is a natural number of 1 or more, X represents O or —OCO—, $R^2$ represents a hydrocarbon group having from 1 to 80 carbon atoms, which may have a substituent, and n represents an integer of 1 to 15, preferably 1 to 4.

Said hydrocarbon group $R^1$ has from 1 to 80 carbon atoms, preferably has from 1 to 20 carbon atoms, and more preferably has from 2 to 6 carbon atoms.

Said hydrocarbon group $R^2$ has from 1 to 80 carbon atoms, preferably has from 16 to 30 carbon atoms, and more preferably has from 18 to 26 carbon atoms.

Further in General Formula (1), "n" represents an integer of 1 to 15, and preferably 1 to 4, more preferably of 2 to 4, further preferably of 3 to 4, and most preferably exactly 4. The greater "n" (1 to 4) becomes, the more the number of branches increase so that crystals in the metastable region (crystals which are thin as well as thermally unstable) tend to be created.

Esters which constitute the toner of the present invention may be suitably synthesized employing dehydration condensation reaction of alcohols with carboxylic acids.

The most appropriate esters are those derived from pentaerythritol tetrabehenic acid.

Specific examples of specified compounds, which are employed in the toner of the present invention, include those represented by formulas 1) through 22).

$$CH_3—(CH_2)_{12}—COO—(CH_2)_{17}—CH_3 \quad (1)$$

$$CH_3—(CH_2)_{13}—COO—(CH_2)_{17}—CH_3 \quad (2)$$

$$CH_3—(CH_2)_{20}—COO—(CH_2)_{21}—CH_3 \quad (3)$$

$$CH_3—(CH_2)_{14}—COO—(CH_2)_{19}—CH_3 \quad (4)$$

$$CH_3—(CH_2)_{20}—COO—(CH_2)_6—O—CO—(CH_2)_{20}—CH_3 \quad (5)$$

(6)

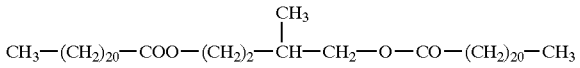

(7)

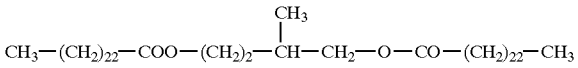

(8)

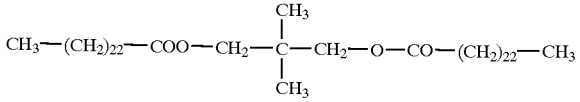

(9)

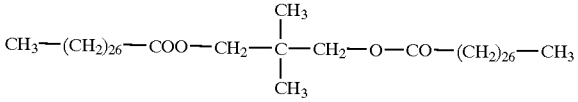

10)

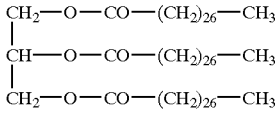

11)

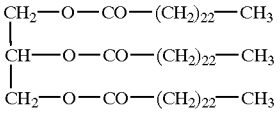

12)

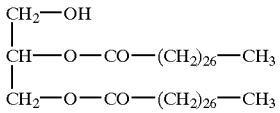

13)

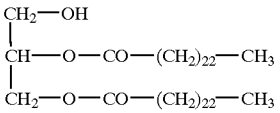

14)

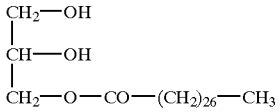

15)

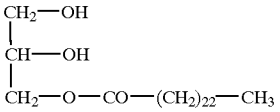

-continued (16)

$$CH_3-(CH_2)_{26}-COO-CH_2-C(CH_3)(CH_2-O-CO-(CH_2)_{26}-CH_3)(CH_2-O-CO-(CH_2)_{26}-CH_3)$$

(17)

$$CH_3-(CH_2)_{20}-COO-CH_2-C(CH_2CH_3)(CH_2-O-CO-(CH_2)_{20}-CH_3)(CH_2-O-CO-(CH_2)_{20}-CH_3)$$

(18)

$$CH_3-(CH_2)_{26}-COO-CH_2-C(CH_2-O-CO-(CH_2)_{26}-CH_3)(CH_2-O-CO-(CH_2)_{26}-CH_3)(CH_2-O-CO-(CH_2)_{26}-CH_3)$$

(19)

$$CH_3-(CH_2)_{20}-COO-CH_2-C(CH_2-O-CO-(CH_2)_{20}-CH_3)(CH_2-O-CO-(CH_2)_{20}-CH_3)(CH_2-O-CO-(CH_2)_{20}-CH_3)$$

(20)

$$CH_3-(CH_2)_{18}-COO-CH_2-C(CH_2-O-CO-(CH_2)_{18}-CH_3)(CH_2-O-CO-(CH_2)_{18}-CH_3)(CH_2-O-CO-(CH_2)_{18}-CH_3)$$

(21)

$$CH_3-(CH_2)_{16}-COO-CH_2-C(CH_2-O-CO-(CH_2)_{16}-CH_3)(CH_2-O-CO-(CH_2)_{16}-CH_3)(CH_2-O-CO-(CH_2)_{16}-CH_3)$$

(22)

$$CH_3-(CH_2)_{20}-COO-CH_2-C(CH_2-O-CO-CH_3)(CH_2-O-CO-CH_3)(CH_2-O-CO-CH_3)$$

(23)

Diglycerol monoesters $$CH_2(OH)-CH(OH)-CH_2-O-CH_2-CH(OH)-CH_2-O-CO-(CH_2)_{20}-CH_3$$

(24)

$$CH_2(OH)-CH(OH)-CH_2-O-CH_2-CH(OH)-CH_2-O-CO-(CH_2)_{18}-CH_3$$

(25)

$$CH_2(OH)-CH(OH)-CH_2-O-CH_2-CH(OH)-CH-O-CO-(CH_2)_{22}-CH_3$$

(26)

Diglycerol diesters $$CH_3-(CH_2)_{20}-COO-CH_2-CH(OH)-CH_2-O-CH_2-CH(OH)-CH_2-O-CO-(CH_3)_{20}-CH_3$$

(27)

$$CH_2(OH)-CH(O-CO-(CH_2)_{20}-CH_3)-CH_2-O-CH_2-CH(OH)-CH_2-O-CO-(CH_3)_{20}-CH_3$$

(28)

$$CH_2(OH)-CH(OH)-CH_2-O-CH_2-CH(O-CO-(CH_2)_{20}-CH_3)-CH_2-O-CO-(CH_3)_{20}-CH_3$$

(29)

Diglycerol trimesters $$CH_3-(CH_2)_{20}-COO-CH_2-CH(O-CO-(CH_2)_{20}CH_3)-CH_2-O-CH_2-CH(OH)-CH_2-O-CO-(CH_3)_{20}-CH_3$$

(30)

$$CH_2(OH)-CH(O-CO-(CH_2)_{20}CH_3)-CH_2-O-CH_2-CH(O-CO-(CH_2)_{20}CH_3)-CH_2-O-CO-(CH_3)_{20}-CH_3$$

(31)

Diglycerol tetraester $$CH_3-(CH_2)_{20}-COO-CH_2-CH(O-CO-(CH_2)_{20}CH_3)-CH_2-O-CH_2-CH(OCO(CH_2)_{20}-CH_3)-CH_2-O-CO-(CH_3)_{20}-CH_3$$

(32)

Triglycerol monoester $$CH_2(OH)-CH(OH)-CH_2-O-CH_2-CH(OH)-CH_2-O-CH_2CH(OH)CH_2-O-CO-(CH_2)_{20}-CH_3$$

(33)

Triglycerol diester $$CH_2(OH)-CH(OCO(CH_2)_{20}CH_3)-CH_2-O-CH_2-CH(OH)-CH_2-O-CH_2CH(OH)CH_2-O-CO-(CH_3)_{20}-CH_3$$

-continued
(34)
Triglycerol triester
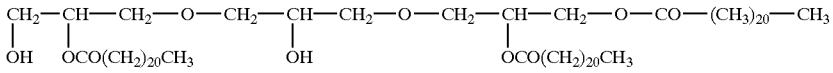
(35)
Triglycerol tetraester
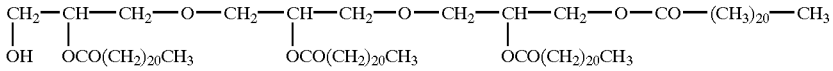
(36)
Triglycerol pentaester
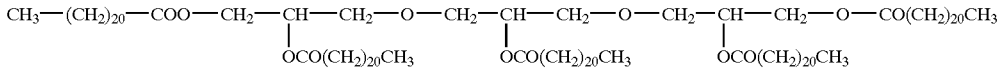
(37)
Erythritol monoester
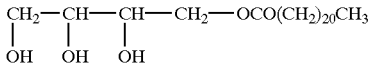
(38)
Erythritol diester
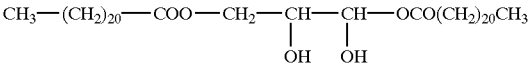
(39)
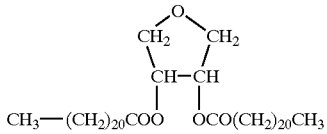
(40)
Erythritol triesters
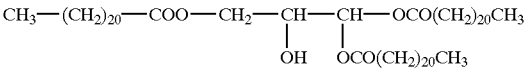
(41)
Erythritol tetraesters
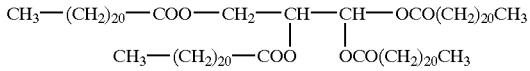
(42)
Sorbitan esters
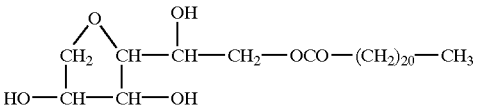
(43)
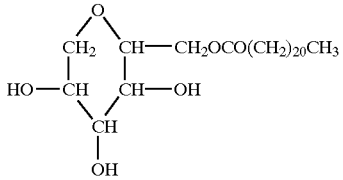
(44) Compound 1-1
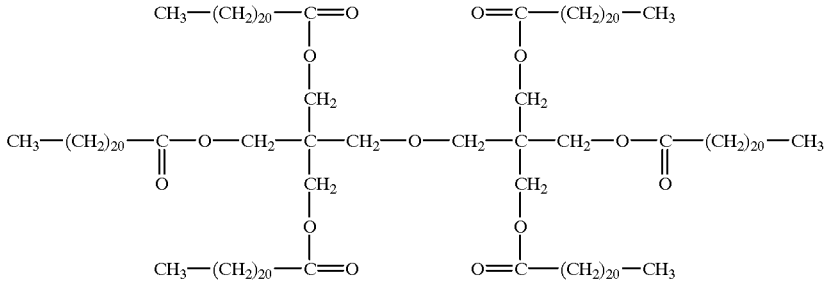

-continued
(45) Compound 1-2
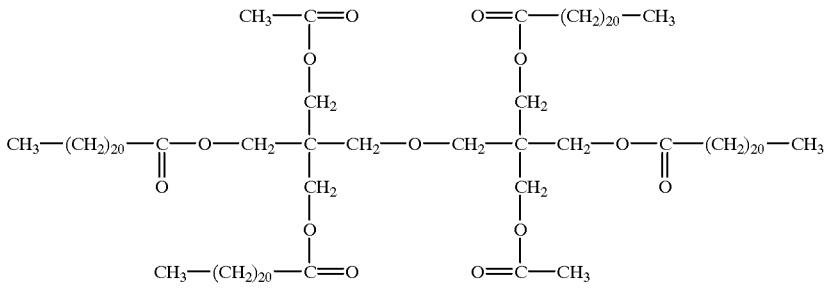
(46) Compound 1-3
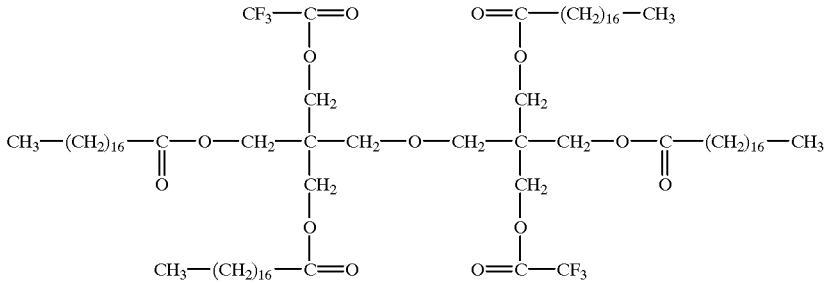
(47) Compound 1-4
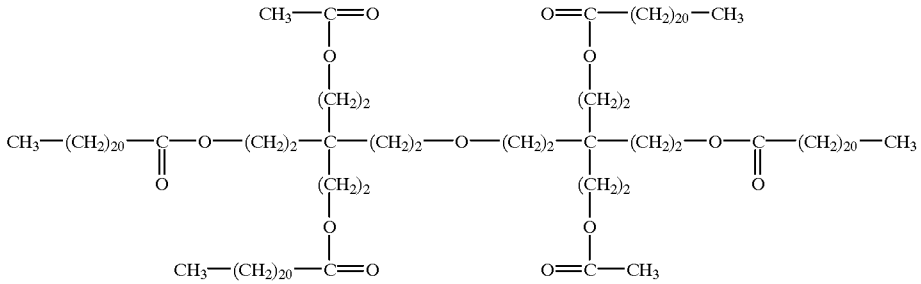
(48) Compound 1-5
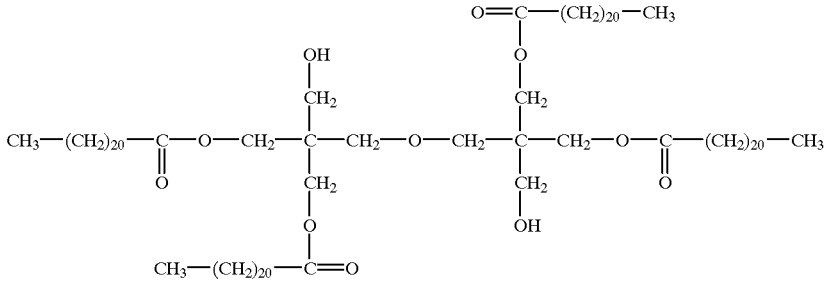
(49) Compound 1-6
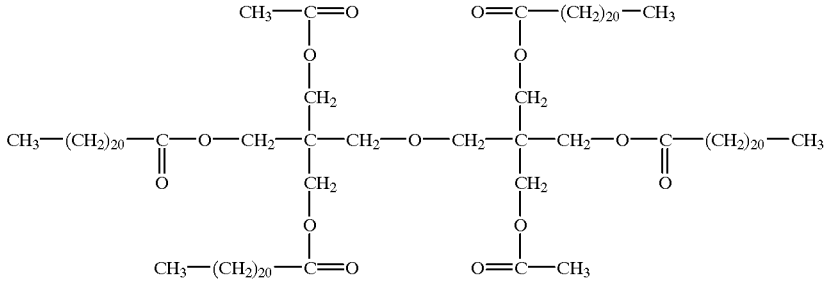

-continued
(50) Compound 1-7
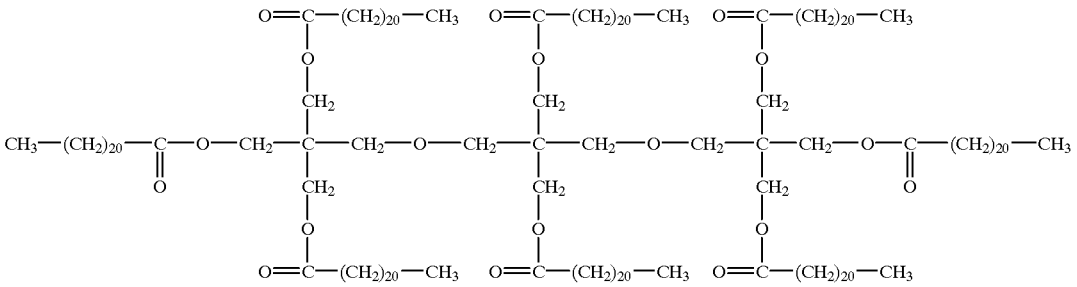
(51) Compound 1-8
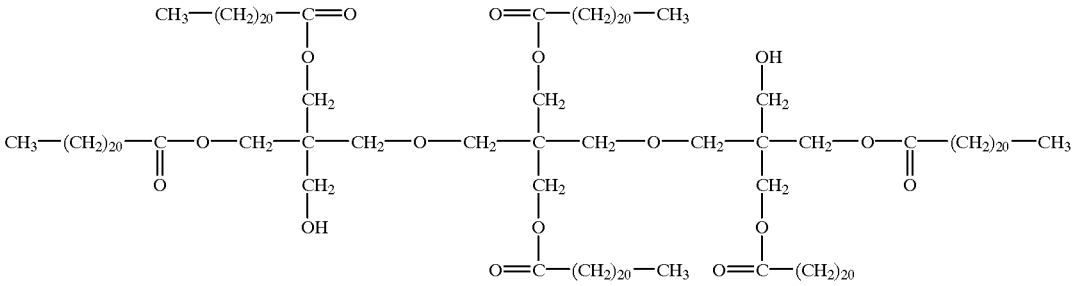
(52) Compound 1-9
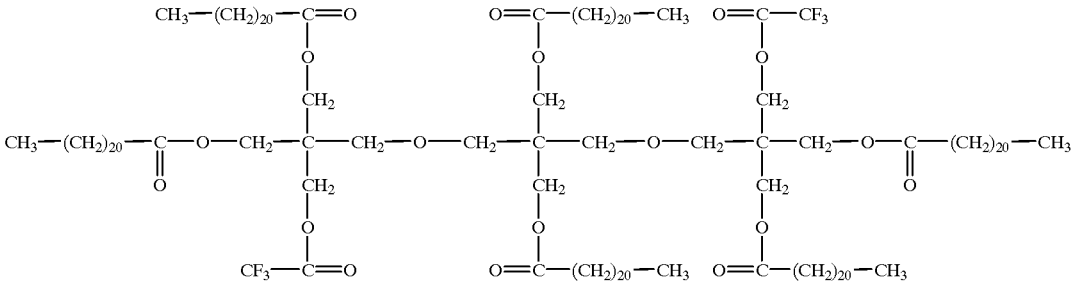
(53) Compound 1-10
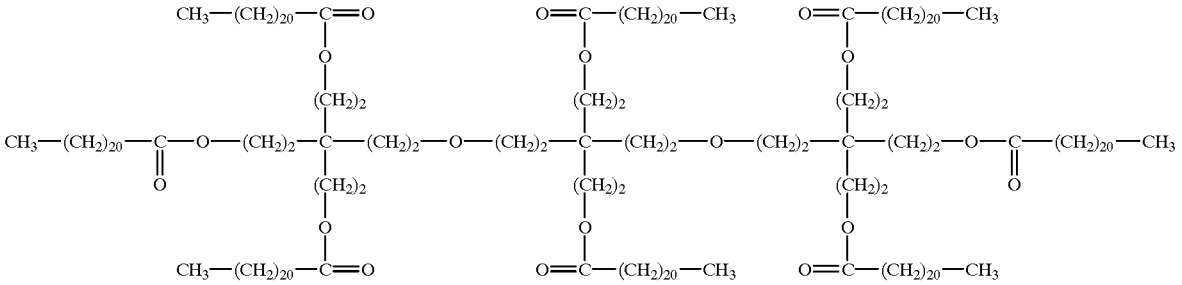
(54) Compound 2-1
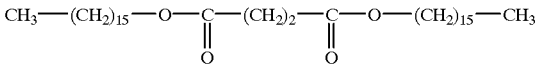
(55) Compound 2-2
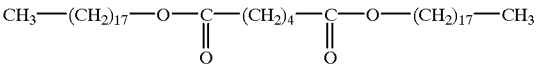
(56) Compound 2-3
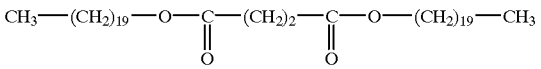
(57) Compound 2-4
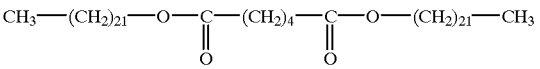
(58) Compound 2-5
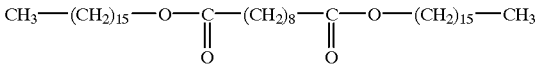
(59) Compound 2-6
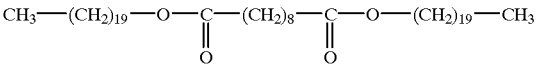

-continued

(60) Compound 2-7

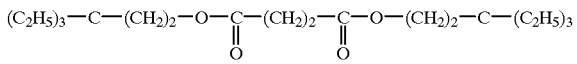

(61) Compound 2-8

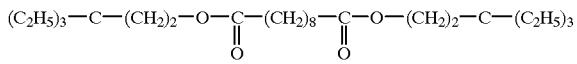

<Thermal Behavior of Specified Crystalline Compounds>

The specified compounds, which constitute the toner of the present invention, preferably exhibit at least one recrystallization peak in the DSC curve during the second heating process, which is determined by employing a DSC.

When employing the specified crystalline compounds which exhibit the recrystallization peak during the second heating process, determined by the DSC, crystals in the metastable region tend to be created when cooling them from their melt state during toner production.

In the DSC curve of the specified crystalline compounds determined by employing a DSC, recrystallization peak temperature $t_{rc}$, during the second heating process, is preferably positioned between on-set temperature $t_{20}$ during the second heating process and melting peak temperature $t_{2m}$ during the second heating temperature.

Specifically, recrystallization peak temperature $t_{rc}$ is most preferably positioned in the range of ($t_{20}$+5° C.) to ($t_{2m}$−2° C.).

In the DSC curve of the specified crystalline compounds determined by employing a DSC, crystallization peak temperature $t_{1c}$ during the first cooling process is preferably 10 to 30° C. lower than melting peak temperature $t_{1m}$ during the first heating process.

When peak temperature difference, $t_{1m}-t_{1c}$, is less than 10° C., said specified crystalline compounds become excessively uniform so that slippage on the crystal surface in the cover layer comprised of said specified crystalline compounds tends to occur. By contrast, when the peak temperature difference, $t_{1m}-t_{1c}$, exceeds 30° C., the crystal size of said specified crystalline compounds becomes non-uniform so that the strength of the cover layer tends to be degraded.

<Properties of Specified Crystalline Compounds>

The hardness of specified crystalline compounds, which constitute the toner of the present invention, is preferably not more than 5 in terms of penetration number determined at a temperature of 50° C. under a load of 150 g, and is more preferably not more than 2. By adjusting said penetration number to not more than 5, it is possible to allow the cover layer comprised of said specified crystalline compounds to exhibit the desired dynamical properties (surface protection effects from stress).

Herein, measurement methods of the penetration number of specified crystalline compounds can include the penetration number measurement method described in JIS K 2235 (1991). Namely, the measurement can be carried out employing the penetration number test method described in Section 5.4 of JIS K 2235 (1991).

<Content Ratio of Specified Crystalline Compounds>

The content ratio of the specified compounds, which constitute the toner of the present invention, is to be commonly between 3 and 40 parts by weight with respect to 100 parts by weight of the binder resin, and is to be preferably between 5 and 35 parts by weight. When the content ratio of said specified crystalline compounds is less than 3 parts by weight, it is impossible to form the cover layer (which exhibits excellent surface protection effects) comprising crystals in the metastable region on the fixed image surface. On the other hand, when the content ratio of said specified crystalline compounds exceeds 40 parts by weight, the ratio of crystals in the metastable region in the cover layer, formed on the fixed image surface, becomes excessive, and in such a cover layer, deformation due to stress is accelerated so that it is also impossible to allow them to exhibit functions to protect the fixed image surface.

<Thermal Behavior of Toners>

The second feature of the toner of the present invention is that in the DSC curve determined by a DSC, at least one recrystallization peak during the second heating process is evident.

When employing a toner having at least one recrystallization peak during the second heating process, it is possible to form the cover layer comprising crystals in the metastable region on the fixed image surface.

Further, said cover layer comprising crystals in the metastable region can protect fixed images from almost every kind of physical stressing and can minimize the formation of abrasion marks, scratches, dents, and the like. By contrast, in the cover layer (comprised of perfect crystals) which is not comprised of crystals in the metastable region, the size of crystals increases excessively. As a result, the crystal surface tends to be destroyed due to slippage at a low temperature so that it is impossible to sufficiently exhibit the desired surface protective function for the fixed images.

In the DSC curve of the toner of the present invention determined by employing the DSC, recrystallization peak temperature $T_{rc}$ (in ° C.) is preferably between glass transition temperature Tg (in ° C.) determined during the second heating process and melting peak temperature $T_{2m}$ (in ° C.) during the second heating process.

Specifically the recrystallization peak temperature $T_{rc}$ of the toner of the present invention is most preferably between (Tg+2° C.) and ($T_{2m}$−2° C.).

The glass transition temperature Tg during the second heating process as described herein refers to one determined by employing the DSC curve. Specifically, the aforementioned DSC-7 (manufactured by Perkin-Elmer Corp.) is employed. Heating and cooling conditions are as follows: after being set aside at 0° C. for one minute, heating is carried out to 200° C. at 10° C./minute (the first heating process); subsequently, after being set aside at 200° C. for one minute, cooling is carried out to 0° C. at 10° C./minute; and after being set aside at 0° C. for one minute, heating is carried out to 200° C. at 10° C./minute (a second heating process). The value determined during said second heating process employing an on-set method, namely the intersecting point of the base line of peaks and the most declined straight line of the peak is defined as the glass transition point.

In the DSC curve of the toner of the present invention, determined by employing a DSC, crystallization peak temperature $T_{1c}$ (in ° C.) during the cooling process is preferably 10 to 40° C. lower than melting peak temperature $T_{1m}$ during the first heating process.

When peak temperature difference, $T_{1m}-T_{1c}$, is less than 10° C., crystal surface slippage tends to occur in the cover layer formed on the toner image surface. On the other hand, when said peak temperature difference, $T_{1m}-T_{1c}$, exceeds 40° C., the size of crystals, which constitute the cover layer formed on the fixed image surface, becomes non-uniform so that the strength of said cover layer tends to be degraded.

FIG. 1 is a curve diagram showing one example of the DSC curve of the toner of the present invention during the second heating process. In FIG. 1, 2M is the melting peak, $S_{2m}$ (the oblique line area) is the peak area of said melting peak 2M, RC is the recrystallization peak, $S_{rc}$ (the oblique line area) is the peak area of said recrystallization peak RC, and BL is the base line.

In the DSC curve (the second heating process) of the toner of the present invention, the ratio $S_{rc}/S_{2m}$ of the peak area $S_{rc}$ of recrystallization peak RC (at peak temperature $T_{rc}$) to the peak area $S_{2m}$ of melting peak 2M (at peak temperature $T_{2m}$) is preferably between 5 and 100 percent.

By employing such a toner, it is possible to form a cover layer on the fixed image surface, which comprises the suitable range (the range in which excellent surface protection effects are exhibited) of crystals in the metastable region.

<Binder Resins>

Binder resins, which constitute the toner of the present invention, are not particularly limited. Said binder resins include conventional resins known in the art, such as styrene-acrylic copolymers, styrene-methacrylic copolymers, polyester resins, epoxy resins, styrene-butadiene copolymers and the like.

Of these resins, it is preferable to select resins which do not adversely affect the thermal behavior (the formation of the cover layer compromising crystals in the metastable region) of the specified compounds. Accordingly, it is possible to appropriately select suitable resinous materials in response to the types of specified crystalline compounds employed.

Herein, listed as resins, which are suitably combined with the specified crystalline compounds, may be styrene-acryl resins and styrene-butadiene resins. The reason for this being so is not well understood. However, it is assumed that difference in solubility between said crystalline compounds and said resins is optimized, and by the combination with said resins, it becomes easy to allow said crystalline compounds to exist in said resins in a so-called domain-like dispersion state so that the crystal structure proposed in the present invention is readily formed.

When the toner of the present invention is produced by employing a polymerization method, as polymerizable monomers which are employed to obtain the binder resin which constitutes said toner, radical polymerizable monomers are critical components, and if desired, crosslinking agents may be employed. Further, at least one type of radical polymerizable monomer having an acidic group or radical polymerizable monomers having a basic group, as shown below, is preferably incorporated.

(1) Radical Polymerizable Monomers

Radical polymerizable monomers are not particularly limited, and conventional radical polymerizable monomers known in the art may be employed. Further, they may be employed in combination of two or more types, so that desired properties are obtained.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin based monomers, and the like.

Listed as aromatic vinyl monomers are, for example, styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrene, 3,4-dichlorostyrene, and the like.

Listed as acrylic or methacrylic acid ester based monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the properties of a toner, radical polymerizable crosslinking agents may be added as the crosslinking agents. Said radical polymerizable crosslinking agents include those having at least two unsaturated bonds, such as divinylbenzene, divinylnaphthalene, divinyl ether, diethylene glycol methacrylate, ethylene glycol dimethacrylate, polyethylene glycol dimethacrylate, diallyl phthalate, and the like.

(3) Radical Polymerizable Monomers having an Acidic Group or Radical Polymerizable Monomers having a Basic Group Employed as radical polymerizable monomers having an acidic group or radical polymerizable monomers having a basic group may be, for example, monomers having a carboxyl group, monomers having a sulfonic acid group, and amine based compounds such as primary, secondary, tertiary, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like.

Listed as monomers having a sulfonic acid group are styrenesulfonic acid, allylsulfosuccinic acid, octyl allylsulfosuccinate, and the like.

These may form salts with alkali metals such as sodium, potassium, and the like or with alkali earth metals such as calcium and the like.

Listed as radical polymerizable monomers having a basic group may be amine based compounds such as dimethylaminoethyl acrylate, diethylaminoethyl methacrylate, diethylaminoethyl acrylate, diethylaminoethyl methacrylate, and quaternary ammonium salts of said four compounds; 3-dimethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridinium chloride, N,N-diallylmethylammonium chloride, N,N-diallylethylammonium chloride; and the like.

When radical polymerizable monomers are employed to obtain the toner of the present invention, either radical polymerizable monomers having an acidic group or radical polymerizable monomers having a basic group are preferably employed in an amount of 0.1 to 15 percent by weight with respect to the total monomers, and radical polymerizable crosslinking agents are preferably employed in an amount of 0.1 to 10 percent by weight with respect to the total radical polymerizable monomers, though the amount depends on the properties of said crosslinking agents.

(4) Chain Transfer Agents

For the purpose of controlling the molecular weight of binder resins, it is possible to employ commonly used chain transfer agents.

Said chain transfer agents are not particularly limited, and for example, employed are mercaptans such as octylmercaptan, dodecylmercaptan, tert-dodecylmercaptan, and the like, and styrene dimers and the like.

(5) Polymerization Initiators

Radical polymerization imitators employed to obtain the toner of the present invention are not particularly limited, and it is possible to optionally use either water-soluble or oil-soluble polymerization initiators. Listed as water-soluble radical polymerization initiators are, for example, persulfate salts (such as potassium persulfate, ammonium persulfate, and the like), azo based compounds (such as 4,4'-azobis-cyanovaleric acid and salts thereof, 2,2'-azobis(2-amidinopropane) salt, and the like), peroxides, and the like.

Further, if desired, it is possible to convert said radical polymerization initiators to redox based initiators upon combining them with reducing agents. By employing said redox based initiators, it is possible to lower the polymerization temperature due to an increase in polymerization activity and thus to expect a decrease in the polymerization time.

Polymerization temperature may be optionally selected as long as said temperature exceeds the minimum radical forming temperature of said polymerization initiators. For example, the temperature range of 50 to 90° C. is employed. However, by employing a combination with polymerization initiators such as a combination of hydrogen peroxide-reducing agent (such as ascorbic acid and the like), capable of initiating the polymerization at room temperature, it is possible to carry out polymerization at room temperature or at higher temperature.

(6) Surface Active Agents

In order to carry out emulsion polymerization employing said radical polymerizable monomers, the addition of surface active agents is required. Said surface active agents, which are employed for the emulsion polymerization, are not particularly limited, and the ionic surface active agents shown below may be listed as suitable examples.

Listed as ionic surface active agents may be sulfonic acid salts (such as sodium dodecylbenzenesulfonate, sodium arylalkylpolyethersulfonate, sodium 3,3-disulfondiphenylurea-4,4-diazo-bisamino-8-naphthol-6-sulfonate, ortho-carboxybenzene-azo-dimethylaniline, sodium 2,2,5,5-tetramethyl-triphenylmethnae-4,4-diazo-bis-β-naphthol-6-sulfonate, and the like), sulfuric acid ester salts (such as sodium dodecylsulfate, sodium tetradecylsulfate, sodium pentadecylsulfate, sodium octylsulfate, and the like), fatty acid salts (such as sodium oleiate, sodium lauriate, sodium capriate, sodium capryliate, sodium caproate, potassium stearate, calcium oleiate, and the like.

Further, nonionic surface active agents may also be employed. Specifically cited may be polyethylene oxide, polypropylene oxide, a combination of polypropylene oxide and polyethylene oxide, esters of polyethylene glycol with higher fatty acids, esters of alkylphenolpolyethylene oxide and higher fatty acids with polyethylene glycol, esters of higher fatty acids with polypropylene oxide, sorbitan esters, and the like.

In the present invention, these are primarily employed as emulsifying agents during emulsion polymerization. However, these may also be employed in other processes or for other purposes.

<Colorants>

Listed as colorants, which constitute part of the toner, may be inorganic pigments as well as organic pigments.

Employed as said inorganic pigments may be those conventionally known in the art. Specific inorganic pigments are shown below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments may be those conventionally known in the art. Specific organic pigments are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

If desired, these organic pigments may be employed individually or in combination of selected ones. Further, the added amount of pigments is commonly between 2 and 20 percent by weight, and is preferably between 3 and 15 percent by weight.

Said colorants may also be employed while being subjected to surface modification. As said surface modifying agents may be those conventionally known in the art, and specifically, employed preferably may be silane coupling agents, titanium coupling agents, aluminum coupling agents, and the like.

<External Additives>

For the purpose of improving fluidity as well as chargeability, and of enhancing cleaning properties, the toner of the present invention may be employed into those in which so-called external additives are incorporated. Said external additives are not particularly limited, and various types of fine inorganic particles, fine organic particles, and lubricants may be employed.

Methods for producing the toner of the present invention are not particularly limited, and said toner may be produced employing a kneading pulverizing method, and a polymerization method, and in addition, a melt spray method.

Of these methods, the polymerization method (a suspension polymerization method and an emulsion polymerization method) is preferably employed in which a monomer composition comprised of specified crystalline compounds as well as polymerizable monomers is directly polymerized in a water phase, because the temperature can be more readily controlled, as well as the cooling treatment can be more efficiently carried out.

Further, since temperature control is readily carried out during rapidly heating the specified crystalline compounds and rapidly cooling the same, the polymerization method (an emulsion polymerization coalescence method) is most preferably employed in which the monomer composition comprised of said specified crystalline compounds as well as said polymerizable monomers is directly polymerized in a water phase.

A method for suitably producing the toner of the present invention (production method of the present) will now be described.

<Production Method of Toner>

The production method of the present invention is characterized in that toner materials comprised of the specified crystalline compounds are provided with a specified thermal history (maximum temperature, as well as cooling rate).

(1) Kneading Pulverizing Method

In one example of the production method of the present invention (a kneading pulverizing method in which at least a binder resin, a colorant, and a specified crystalline compound are dry mixed, melt kneaded employing a kneader, and if desired, classified), the maximum temperature during melt kneading is set at no lower than the melting peak temperature $t_{1m}$ (in ° C.) during the first heating process of said crystalline compound, determined by employing a DSC, and further, a process is included in which toner materials, ejected from the kneader, is cooled at a cooling rate of 1 to 20° C./second to the specified temperature which is no higher than $t_{1m}$−30° C.

"Toner materials" in the kneading pulverizing method, as described herein, refer to kneading materials comprised of at least a binder resin, a colorant, and a specified crystalline compound.

Further, the highest temperature applied to said toner materials during kneading is generally the highest temperature in the production processes. For example, it is the temperature of the material (melt kneading materials) at the ejection exit of a kneader. Said highest temperature is to be at least $t_{1m}$ (in ° C.), and is preferably to be between $t_{1m}$ (in ° C.) and $t_{1m}$+100° C. By heating said toner raw materials (kneading material) to such a temperature, it is possible to convert said specified crystalline compounds into a perfectly melt state.

Subsequently, said toner material is cooled (rapidly cooled). Specifically, said toner material is cooled at a cooling rate of 1 to 20° C./second to the specified temperature (for example, between normal temperature and 45° C.), which is not more than $t_{1m}$−30° C. Only by carrying out such a rapid cooling, obtained is a pulverized toner which exhibits the specific thermal behavior, that is the toner of the present invention which can securely form a cover layer comprising crystals in the metastable region in an appropriate amount.

(2) Polymerization Method

In another example (being a polymerization method) of the production method of the present invention, included is a process in which toner raw materials comprising the specified crystalline compounds are provided with a temperature (maximum temperature) higher than the melting peak temperature $t_{1m}$ (in ° C.) of said crystalline compounds during the first heating process, determined by employing the DSC, and said toner raw materials are cooled at a cooling rate of 1 to 20° C./minute from said highest temperature to the specified temperature which is not higher than $t_{1m}$−30° C.

"Toner raw materials" in the suspension polymerization, as described herein, refer to monomer compositions comprised, for example, of polymerizable monomers and the specified crystalline compounds, as well as of polymer particles which are obtained employing said monomer compositions.

Further, the maximum temperature provided to said toner raw materials is, for example, the polymerization reaction temperature. The maximum temperature is to be at least $t_{1m}$ (in ° C.), and is to be preferably between $t_{1m}$ (in ° C.) and $t_{1m}$+100° C. By heating said toner material to such a temperature, it is possible to convert the specified crystalline compounds completely to a melted state.

Subsequently, polymer particles as the toner raw materials are subjected to a cooling treatment (rapid cooling treatment). Specifically, cooling is carried out at a cooling rate of 1 to 20° C./minute to the specified temperature (for example, between normal temperature and 45° C.), which is at least $t_{1m}$−30° C. Only by carrying out such a rapid cooling treatment, obtained is a suspension polymerization toner which exhibits specific thermal behavior, that is, the toner of the present invention, which can securely form a cover layer which comprises crystals in the metastable region in an appropriate amount. Incidentally, it is not preferred that toner raw materials (monomer composition and polymer particles) are cooled at a cooling rate exceeding 20° C./minute, because the ratio of crystals in a metastable state becomes excessive or a non-crystalline state results. Namely, cooling in the polymerization method is different from the kneading pulverizing method, and particle-like portions are cooled. As a result, it is possible to allow the crystalline compounds to remain in a crystalline state in the interior of particles under rather slower conditions compared to the case of the kneading pulverizing method.

Further, "toner raw materials", as described in the emulsion polymerization coalescence method detailed below, refer to a fine particle dispersion (latex) which is obtained by directly emulsion-polymerizing a monomer composition comprised of, for example, polymerizable monomers and specified crystalline compounds in a water phase, and coalesced particles which are obtained by coalescing said fine particles.

Further, the maximum temperature provided to said toner material is, for example, the coalescing treatment temperature of said fine particles. Said maximum temperature is to be at least $t_{1m}$ (in ° C.), and is to be preferably between $t_{1m}$ (in ° C.) and $t_{1m}$+100° C. By heating said toner materials (latex) to such a temperature, it is possible to convert the specified crystalline compounds totally to a melted state.

Subsequently, said coalesced particles as the toner raw materials) are cooled (rapidly cooled). Specifically, cooling is carried out at a cooling rate of 1 to 20° C./minute to the specified temperature (for example, between normal ambient temperature and 45° C.), which is to be no higher than $t_{1m}$−30° C. Only by carrying out such rapid cooling, obtained is an emulsion polymerization coalescence type toner which exhibits specific thermal behavior, that is, being that of the toner of the present invention, which can securely form a cover layer which comprises crystals in the metastable region in an appropriate amount.

Incidentally, it is not preferable that said toner material is cooled at a cooling rate exceeding 20° C./minute, because the ratio of crystals in a metastable state becomes excessive, or a non-crystalline state results.

One example of the production method (emulsion polymerization coalescence method) will now be detailed.

Said production method comprises:

(1) a dissolving process in which specified crystalline compounds are dissolved in radical polymerizable monomers,
(2) a polymerization process to prepare a fine resinous particle dispersion,
(3) a fusion process in which fine resinous particles are fused in a water based medium so that toner particles (coalesced particles) are obtained,
(4) a cooling process in which the resultant toner particle dispersion is cooled,
(5) a filtration and washing process in which said toner particles are separated from said cooled toner particle dispersion employing filtration, and surface active agents and the like are removed from said toner particles,
(6) a drying process in which washed toner particles are dried, and said process may comprise:
(7) a process in which external additives are added to said dried toner particles.

Each process will now be described in more detail.

(Polymerization Process)

In a suitable example of said polymerization method, droplets of said radical polymerizable monomer solution of specified crystalline compounds are formed in a water based medium (an aqueous solution of surface active agents and radical polymerization initiators), and a polymerization reaction is carried out in said droplets, employing radicals generated by said radical polymerization initiators. Incidentally, oil-soluble polymerization initiators may be incorporated into said droplets. In such a polymerization process, an enforced emulsification (being a formation of droplets) process is essential, in which mechanical energy is applied. Listed as such mechanical energy application means may be means such as homomixers, ultrasonic homogenizers, Manton-Gaulin homogenizers, and the like, which provide strong stirring or ultrasonic vibrational energy.

Said polymerization process enables obtaining fine resinous particles comprised of specified crystalline compounds as well as binder resins. Said fine resinous particles may or may not be tinted. Tinted fine resinous particles may be obtained by polymerizing a monomer composition containing colorants.

Further, when fine resinous particles, which are not tinted, are employed, it is possible to prepare toner particles in such a manner that, during the fusion process described below, a fine colorant particle dispersion is added to a fine resinous particle dispersion so that said fine resinous particles are fused with said fine colorant particles.

(Fusion Process)

As fusion methods during said fusion process, a salting-out/fusion method is preferred in which resinous particles obtained employing the polymerization process are utilized.

Further, during said fusion process, it is possible to fuse fine internal agent particles such as fine releasing agent particles, fine charge control agent particles, and the like, along with said fine resinous particles as well as said fine colorant particles.

"Water based medium" during said fusion process, as described herein, refers to one in which the main component (in an amount of 50 percent by weight) is comprised of water. Herein, listed as components other than water, may be water-soluble organic solvents such as, for example, methanol, ethanol, isopropanol, butanol, acetone, methyl ethyl ketone, tetrahydrofuran, and the like. Of these, preferred are alcohol based organic solvents such as methanol, ethanol, isopropanol, and butanol which do not solve said resins.

It is possible to prepare fine colorant particles by dispersing said colorant into a water based medium. The dispersion treatment of said colorant is carried out in a state in which the concentration of surface active agents in water is adjusted to be higher than the critical micelle concentration (CMC).

Homogenizers, which are employed to carry out dispersion treatment of colorants, are not particularly limited, but listed as preferred homogenizers are ultrasonic homogenizers, mechanical homogenizers, pressurized homogenizers such as a Manton-Gaulin homogenizer and pressure type homogenizers, and medium type homogenizers such as a sand grinder, a Getman mill, a diamond fine mill, and the like. In addition, listed as employed surface active agents may be those which are the same as described above.

Further, colorants (fine particles) may be subjected to surface modification. The surface modification method applied to said colorants is as follows. Colorants are dispersed into a solvent, and surface modification agents are added to the resultant dispersion. The resultant system is heated enough to initiate a reaction. After completion of the reaction, said colorants are collected through filtration, and washing, as well as filtration is repeated while employing the same solvent and subsequently dried whereby colorants (pigments), which have been subjected to treatment employing said surface modification agents, are obtained.

The preferred fusion method or salting-out/fusion method is carried out by employing a process in which salting-out agents comprised of alkaline metal salts, alkaline earth metal salts, and the like are added to water containing fine resinous particles, as well as fine colorant particles, as the coagulant in higher than the critical coagulation concentration, and subsequently, the resultant mixture is heated to the temperature which is at least the glass transition point of said fine resinous particles as well as to at least the melting peak temperature $t_{1m}$ (in ° C.) of said crystalline compound, so that the salting-out as well as fusion is simultaneously carried out. During said process, a method may be employed in which organic solvents, which are infinitely soluble in water, are added, and the glass transition temperature of fine resinous particles is substantially lowered so that fusion is efficiently carried out.

Herein, in alkaline metal salts and alkaline earth metal salts, listed as alkaline metals are lithium, potassium, sodium, and the like, while listed as alkaline earth metals are magnesium, calcium, strontium, barium, and the like. Of these, listed as preferred metals are potassium, sodium, magnesium, calcium, and barium. Further, listed as types of salts are chlorides, bromides, iodides, carbonates, sulfates, and the like.

Further, listed as organic solvents which are infinitely soluble in water are methanol, ethanol, 1-propanol, 2-propanol, ethylene glycol, glycerin, acetone, and the like. Of these, preferred are alcohols having 3 or fewer carbon atoms such as methanol, ethanol, 1-propnaol, 2-propanol, and 2-propanol is particularly preferred.

When the fusion is carried out employing salting-out/fusion, it is preferable that setting time after the addition of salting-out agents be as short as possible. The reason for this is not well understood. However, the aggregation state of particles varies depending on the setting time. As a result, problems occur in which the particle size distribution fluctuates and surface properties of fused toner particles fluctuate. Further, it is required that the temperature during the addition of salting-out agents is not higher than the glass transition point of the resinous also particles. When the temperature during the addition of salting-out agents is not lower than the glass transition point of said fine resinous particles, said fine resinous particles are subjected to rapid salting-out/fusion. However, it is difficult to control the particle diameter, and problems such as the generation of particles having larger diameter occurs. The temperature range during said addition should be not higher than the glass transition temperature of resins. Said range is commonly from 5 to 55° C., and is preferably from 10 to 45° C.

Further, in the present invention, salting-out agents are added at a temperature no higher than the glass transition temperature of fine resinous particles, and thereafter, the resultant mixture is rapidly heated to a temperature no lower than the glass transition temperature of said fine resinous particles, as well as no lower than the melting peak temperature $t_{1m}$ (in ° C.) of the aforementioned specified crystalline compound.

Duration for said heating is preferably less than one hour. Further, it is required to be heated rapidly and the heating rate is preferably at least 0.25° C./minute, while its upper limit is not particularly limited. However, when the temperature is increased too rapidly, salting-out proceeds abruptly to cause difficulties in control of the particle diameter. Therefore, the heating rate is preferably not more than 5° C./minute.

Employing said fusion process, obtained is a dispersion comprised of coalesced particles (toner particles) which are formed by allowing fine resinous particles as well as optional fine particles to be subjected to salting-out/fusion.

(Cooling Process)

This process is one in which said toner particle dispersion is cooled (rapidly cooled). The cooling is carried out so as to reach the specified temperature, which is no higher than $t_{1m}$−30° C., at a cooling rate of 1 to 20° C./minute.

Cooling methods are not particularly limited, and it is possible to illustrate a method in which cooling is carried out by introducing a refrigerant from the exterior of the reaction vessel, or a method in which cooling is carried out by placing chilled water directly into the reaction system.

(Filtration and Washing Process)

In said filtration and washing process, filtration is carried out in which said toner particles are collected from the toner particle dispersion, cooled to the specified temperature, which is no higher than $t_{1m}$−30° C. during said process, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing a glass filter and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

<Image Forming Method>

The image forming method of the present invention is one comprising a process (a fixing process carried out employing a heating roll method) in which a toner image, which has been transferred to an image support, is heated and pressure fixed. It is characterized in that the toner, which is provided to form images, comprises the specified crystalline compound, and in the DSC curve of said specified crystalline compound, there is at least one recrystallization peak during the second heating process.

By employing said heating roll method as the fixing method, it is possible to form a uniform cover layer (a cover layer having a uniform thickness, a uniform crystal structure, and uniform dynamical properties) on the surface of fixed images.

In the image forming method of the present invention, it is preferable that the surface temperature, Th, of said heating roll is no lower than the temperature (recrystallization peak temperature $t_{rc}$) in said recrystallization peak, and the surface temperature, Tp, of said image support 3 seconds after passing a fixing nip is at least 90° C. lower than the surface temperature Th of said heating roll. Further the temperature difference (Th−Tp) is most preferably at least 120° C. By adjusting the temperature difference (Th−Tp) to at least 120° C., it is possible to securely form a cover layer on the formed fixed image which comprises crystals in the metastable state in a suitable amount.

Fixing pressure is preferably between 49 and 490 kPa (0.5 and 5 kgf/cm$^2$).

When the fixing pressure is excessively small, it is difficult to have the specified crystalline compound, in a melted state, to ooze out onto the fixed image surface. By contrast, when the fixing pressure is excessively large, the specified compound in a melted state oozes out from the side of the fixed image (layer). Thus it is difficult to efficiently form a cover layer on the fixed image surface.

Nip passing time is preferably between 15 and 70 milliseconds so that the cover layer formed by the specified crystalline compound can cover a wide area including the fixed image surface.

"Nip passing time" as described herein can be obtained by d/v, wherein "d" (in mm) is the length of the contact part (a fixing nip) in the image support advancing direction, formed between the heating roll and the pressure roll, and "v" (in mm/second) is the linear speed of the fixing roll.

Further, from the viewpoint of making the damage on the fixed image surface unnoticeable, the fixing mechanism, in which silicone oil is not coated, is particularly preferred when forming full color images.

Naturally, the glitter of the image surface due to silicone oil is not formed so that it is possible to form further improved color images.

Further, a fixing device, which has no mechanism to clean the heating roll surface, is preferably employed from the viewpoint in which the roll surface is subjected to negligible damage.

EXAMPLES

The examples of the present invention will now be described.

<Preparation of Crystalline Compounds>

Preparation Examples 1 Through 6

Crystalline ester compounds (crystalline compounds (20), (21), (22), (3), (29), and (44)) were prepared in such a manner that according to formulas shown in Table 1, described below, carboxylic acid and alcohol undergo a dehydration condensation reaction.

Comparative Preparation Examples 1 Through 3

Crystalline compounds (comparative crystalline compounds a), b), and c), shown in Table 1 described below were prepared.

(Determination of DSC Curves of Crystalline Compounds)

The melting peak temperature $t_{1m}$ during the first heating process, the crystallization peak temperature $t_{1c}$ during the first cooling process, the on-set temperature $t_{20}$ during the second heating process, the recrystallization peak temperature $t_{rc}$ during the second heating process, and the melting peak temperature $t_2$, during the second heating process of each of crystalline compounds related to said Preparation Examples 1 through 6, as well as said Comparative Preparation Examples 1 though 3 were obtained upon determining said DSC curve. The results are also shown in Table 1.

(Determination of Penetration Number of Crystalline Compounds>

The penetration number (at 50° C. and at a load of 150 g) of each of the crystalline compounds related to said Preparation Examples 1 through 6, as well as said Comparative Preparation Examples 1 though 3, was determined. The results are shown in Table 1 along with the molecular weight distribution.

TABLE 1

| | Crystalline Compound | | | First Heating Process Melting Peak | First Cooling Process Crystallization Peak |
|---|---|---|---|---|---|
| Preparation Example | Compound | Carboxylic Acid | Alcohol | Temperature $t_{1m}$ (in ° C.) | Temperature $t_{1c}$ (in ° C.) |
| 1 | (19) | behenic acid | pentaerythritol | 81 | 63 |
| 2 | (20) | arachic acid | pentaerythritol | 78 | 59 |

TABLE 1-continued

| Preparation Example | Crystalline Compound: Compound | Crystalline Compound: Carboxylic Acid | Crystalline Compound: Alcohol | First Heating Process Melting Peak: Temperature $t_{1m}$ (in ° C.) | First Cooling Process Crystallization Peak: Temperature $t_{1c}$ (in ° C.) |
|---|---|---|---|---|---|
| 3 | (21) | stearic acid | pentaerythritol | 76 | 56 |
| 4 | (3) | behenic acid | behenyl alcohol | 70 | 67 |
| 5 | (29) | behenic acid | diglycerol | 73 | 69 |
| 6 | (44) | behenic acid | pentaerythritol | 81 | 63 |
| Comparative 1 | a | polypropylene | | 139 | 100 |
| Comparative 2 | b | paraffin wax | | 93 | 92 |
| Comparative 3 | c | carnauba wax | | 84 | 75 |

TABLE 1

| Preparation Example | Second Heating Process: On-set Temperature $t_{2o}$ (in ° C.) | Second Heating Process: Recrystallization Peak Temperature $t_{rc}$ (in ° C.) | Second Heating Process: Melting Peak Temperature $t_{2m}$ (in ° C.) | Penetration at 50° C. and at an Applied Load of 150 g | Molecular Weight Distribution: Mn | Mw | Mz | Mw/Mn | Mz/Mw |
|---|---|---|---|---|---|---|---|---|---|
| 1 | 62 | 76 | 82 | 0 | 1980 | 2240 | 2440 | 1.13 | 1.09 |
| 2 | 59 | 70 | 79 | 0 | 2178 | 2419 | 2806 | 1.11 | 1.06 |
| 3 | 56 | 65 | 75 | 0 | 1623 | 1792 | 2049 | 1.10 | 1.14 |
| 4 | 66 | 69 | 70 | 4 | 500 | 630 | 723 | 1.26 | 1.15 |
| 5 | 67 | 69 | 72 | 0 | 1040 | 1140 | 1250 | 1.10 | 1.10 |
| 6 | 62 | 75 | 82 | 0 | 1990 | 2260 | 2460 | 1.14 | 1.09 |
| Comparative 1 | 104 | none | 142 | 7 | 2270 | 8600 | 18400 | 3.79 | 2.14 |
| Comparative 2 | 50 | none | 93 | 10 | 460 | 550 | 640 | 1.20 | 1.16 |
| Comparative 3 | 64 | none | 80 | 6 | 765 | 803 | 890 | 1.05 | 1.11 |

Example 1

(1) Synthesis of Low Molecular Weight Latex

Placed into a 1-liter capacity four-necked flask fitted with a stirring device, a cooling pipe, and a thermal sensor were 509.33 g of styrene, 88.67 g of n-butyl acrylate, 34.83 g of methacrylic acid, 21.83 g of tert-dodecylmercaptan, and 66.7 g of crystalline compound (19) (pentaerythritol tetrabehenic acid ester) obtained in Preparation Example 1, and the internal temperature was raised to 80° C. Stirring was then continued until said crystalline compound (19) was dissolved, and the temperature was maintained.

Meanwhile, an aqueous surface active agent solution, prepared by dissolving 1.0 g of sodium dodecylbenzenesulfonate in 2,700 milliliters of pure water, was heated so that the interior temperature was 80° C., and was maintained at that temperature.

Said aqueous surface active agent solution, maintained at 80° C., was added while stirring it into a monomer solution prepared by dissolving said crystalline compound (20), and the resultant mixture was emulsified employing an ultrasonic homogenizer, whereby an emulsion was obtained. Subsequently, said emulsion was placed into a 5-liter capacity four-necked flask fitted with a stirring device, a cooling pipe, a nitrogen gas inlet pipe and a thermal sensor, and the resultant mixture was stirred under a flow of nitrogen gas while maintaining an interior temperature of 70° C., and added was an aqueous polymerization initiator solution prepared by dissolving 7.52 g of ammonium persulfate in 500 milliliters of pure water. After the resultant mixture underwent polymerization for four hours, it was cooled to room temperature and was filtrated to obtain latex. After the reaction, no polymerization residues were observed and a stable latex was obtained. The obtained latex was designated as "Latex (L-1)".

The number average primary particle diameter of the obtained Latex (L-1) was determined employing an electrophoretic light scattering photometer ELS-800 (manufactured by Otsuka Denshi Co., Ltd.) and a diameter of 125 nm was obtained. Further, its glass transition temperature was determined employing a DSC and the temperature of 58° C. was obtained. Further, the concentration of the solid portion of said latex, which was determined employing a weight method employing static drying, was 20 percent by weight.

(2) Synthesis of High Molecular Weight Latex

Placed into a 500-milliliter capacity four-necked flask fitted with a stirring device, a cooling pipe, and a thermal sensor were 92.47 g of styrene, 30.4 g of n-butyl acrylate, 3.80 g of methacrylic acid, 0.12 g of tert-dodecylmercaptan, and 13.34 g of crystalline compound (19) (pentaerythritol tetrabehenic acid ester) obtained in Preparation Example 1, and the internal temperature was raised to 80° C. Stirring was then continued until said crystalline compound (19) was dissolved, and the temperature was maintained.

Meanwhile, an aqueous surface active agent solution, prepared by dissolving 0.27 g of sodium dodecylbenzenesulfonate in 540 milliliters of pure water, was heated so that an interior temperature was 80° C., and was maintained at that temperature.

Said aqueous surface active agent solution, maintained at 80° C., was added while stirring to a monomer solution prepared by dissolving said crystalline compound (20), and the resultant mixture was emulsified employing an ultrasonic homogenizer, whereby an emulsion was obtained. Subsequently, said emulsion was placed into a 5-liter capacity four-necked flask fitted with a stirring device, a cooling pipe, a nitrogen gas inlet pipe and a thermal sensor, and the resultant mixture was stirred under a flow of nitrogen gas while maintaining an interior temperature of 70° C., and added was an aqueous polymerization initiator solution, prepared by dissolving 0.27 g of ammonium persulfate in 100 milliliters of pure water. After the resultant mixture underwent polymerization for four hours, it was cooled to room temperature and was filtrated to obtain said latex. After the reaction, no polymerization residues were observed and a stable latex was obtained. The obtained latex was designated as "Latex (H-1)".

The number average primary particle diameter of the obtained Latex (H-1) was determined employing an electrophoretic light scattering photometer ELS-800 (manufactured by Otsuka Denshi Co., Ltd.) and a diameter of 108 nm was obtained. Further, its glass transition temperature was determined employing a DSC and a temperature of 59° C. was obtained. Further, the concentration of the solid portion of said latex, which was determined employing a weight method, employing static drying, was 20 percent by weight.

(3) Toner Production

Placed into a 5-liter capacity four-necked flask fitted with a stirring device, a cooling pipe, and a thermal sensor were 250 g of Latex (H-1), 1,000 g of Latex (L-1), 900 milliliters of pure water, and a carbon black dispersion prepared by dispersing 20 g of carbon black, "Regal 33OR" (manufactured by Cabot Corp.), into 9.2 g of an aqueous surface active solution (an aqueous solution prepared by dissolving 9.2 g of sodium dodecylsulfonate in 160 milliliters of pure water), and the pH was adjusted to 10 by adding a 5N aqueous sodium hydroxide solution while stirring.

Further, after adding, while stirring, an aqueous solution prepared by dissolving 28.5 g of magnesium chloride hexahydrate in 1,000 milliliters of room temperature pure water, heating was carried out so that the interior temperature reached 95° C. While maintaining the interior temperature at 95° C., the particle diameter of dispersed particles was measured employing a Coulter Counter II (manufactured by Coulter Co.). When said particle diameter reached 6.5 μm, an aqueous solution prepared by dissolving 80.6 g of sodium chloride in 700 milliliters of pure water was added. While maintaining the interior temperature at 95° C. ($t_{1m}$+14° C.), reaction was continued for 6 hours. After completion of the reaction, the obtained coalesced particle dispersion (at 95° C.) was cooled to 45° C. ($t_{1m}$−36° C.) within 10 minutes (at a cooling rate of 5° C./minute).

Coalesced particles (toner particles) prepared as described above were filtered. After repeated washing, employing redispersion into pure water and further filtration, a toner was obtained by drying. The obtained toner was designated as "Black Toner 1".

The particle diameter of Black Toner 1 was measured employing a Coulter Counter II (manufactured by Coulter Corp.) resulting a volume average particle diameter $d_{50}$ of 6.5 μm, as well as a variation coefficient CV of 18.2 percent.

Example 2-B

A toner was prepared in the same manner as Example 1, except that as the employed amount of the crystalline compound (19), which was added during the preparation of the low molecular weight latex, was changed to 100 g, and the employed amount of the crystalline compound (19), which was added during the preparation of the high molecular weight latex, was changed to 40 g. The obtained toner was designated as "Black Toner 2B".

The particle diameter of Black Toner 2B was measured employing a Coulter Counter II (manufactured by Coulter Corp.), resulting a volume average particle diameter $d_{50}$ Of 6.4 μm, as well as a variation coefficient CV of 18.8 percent.

Example 2-Y

A yellow toner was obtained in the same manner as Example 2-B, except that the carbon black in Example 2-B was replaced with C.I. Pigment Yellow 185. The obtained toner was designated as "Yellow Toner 2Y". The particle diameter of Yellow Toner 2Y was determined employing a Coulter Counter II (manufactured by Coulter Co.), resulting in a volume average particle diameter $d_{50}$ of 6.3 μm and a variation coefficient CV of 17.8 percent.

Example 2-M

A magenta toner was obtained in the same manner as Example 2-B, except that the carbon black in Example 2-B was replaced with C.I. Pigment Red 122. The obtained toner was designated as "Magenta Toner 2M". The particle diameter of Magenta Toner 2M was determined employing a Coulter Counter II (manufactured by Coulter Co.), resulting in a volume average particle diameter $d_{50}$ of 6.5 μm and a variation coefficient CV of 19.1 percent.

Example 2-C

A cyan toner was obtained in the same manner as Example 2-B, except that the carbon black in Example 2-B was replaced with C.I. Pigment Blue 15:3. The obtained toner was designated as "Cyan Toner 2C". The particle diameter of cyan Toner 2C was determined employing a Coulter Counter II (manufactured by Coulter Co.), resulting in a volume average particle diameter $d_{50}$ of 6.5 μm and a variation coefficient CV of 18.6 percent.

Example 3

A black toner was obtained in the same manner as Example 1, except that during the synthesis process of the low molecular weight latex, crystalline compound (19) was replaced with 66.7 g of crystalline compound (20) (pentaerythritol tetraarachic acid ester); during the synthesis process of the high molecular weight latex, crystalline compound (19) was replaced with 13.34 g of crystalline compound (20) (pentaerythritol tetraarachic acid ester); the interior temperature during production of the toner was changed to 90° C. ($t_{1m}$+12° C.); and cooling was carried out to 40° C. ($t_{1m}$−38° C.) at a rate of 2° C./minute. The obtained toner was designated as "Black Toner 3". The particle diameter of Black Toner 3 was determined employing Coulter Counter II (manufactured by Coulter Co.), resulting in a volume average particle diameter $d_{50}$ of 6.6 μm and a variation coefficient CV of 19.2 percent.

Example 4

A black toner was obtained in the same manner as Example 1, except that during the synthesis process of the low molecular weight latex, crystalline compound (19) was replaced with 66.7 g of crystalline compound (20) (pentaerythritol tetraarachic acid ester); during the synthesis process of the high molecular weight latex, crystalline compound (19) was replaced with 13.34 g of crystalline compound (20) (pentaerythritol tetraarachic acid ester); the interior temperature during production of the toner was varied to 85° C. ($t_{1m}$+9° C.); and cooling was carried out to 45° C. ($t_{1m}$−31° C.) at a rate of 5° C./minute. The obtained toner was designated as "Black Toner 4". The particle diameter of Black Toner 4 was determined employing Coulter Counter II (manufactured by Coulter Co.), resulting in a volume average particle diameter $d_{50}$ of 6.5 μm and a variation coefficient CV of 17.3 percent.

Example 5

A black toner was obtained in the same manner as Example 1, except that during the synthesis process of the low molecular weight latex, crystalline compound (19) was replaced with 66.7 g of crystalline compound (20) (pentaerythritol tetraarachic acid ester); during the synthesis process of the high molecular weight latex, crystalline compound (19) was replaced with 13.34 g of crystalline compound (20) (pentaerythritol tetraarachic acid ester); the interior temperature during production of the toner was changed to 85° C. ($t_{1m}$+12° C.); and cooling was carried out to 35° C. ($t_{1m}$−38° C.) at a rate of 5° C./minute. The obtained toner was designated as "Black Toner 5". The particle diameter of Black Toner 5 was determined employing a Coulter Counter II (manufactured by Coulter Co.), resulting in a volume average particle diameter $d_{50}$ of 6.4 m and a variation coefficient CV of 17.3 percent.

Example 6

One hundred parts by weight of styrene-acrylate copolymer, 10 parts by weight of carbon black, 1 part by weight of a metal complex monoazo dye, and 4 parts by weight of crystalline compound (19) (pentaerythritol tetrabehenic acid ester having a melting peak temperature $t_{1m}$ of 81 (in ° C.) was blended employing a Henschel mixer, kneaded employing a biaxial kneader "PCM-30" (manufactured by Ikegai), and classified, whereby a black toner having a volume average particle diameter $d_{50}$ of 6.7 μm. The obtained toner was designated as "Black Toner 6".

Herein, kneading conditions by said biaxial kneader as well as cooling conditions of melted raw materials are as follows:

temperature of the melted raw materials at the injection exit of the kneader: 136° C. ($t_{1m}$+55° C.)

control method of cooling conditions: the temperature of two-staged cooling roller (the temperature and flow rate of chiller circulation water) installed following the kneader was controlled cooling time to lower the temperature to 45° C. ($t_{1m}$−36° C.) 20 seconds (4.6° C./second)

Comparative Example 1

A black toner having a volume average toner diameter $d_{50}$ of 6.6 μm was obtained in the same manner as Example 6, except that crystalline compound (19) was replaced with 4 parts by weight of comparative crystalline compound (polypropylene having a melting peak temperature $t_{1m}$ of 139° C.; kneading conditions were controlled so that the temperature of melted raw materials was 145° C.; and cooling conditions were controlled so that the cooling time to reach $t_{1m}$−39° C. was 10 seconds. The obtained black toner was designated as "Comparative Black Toner 1".

Comparative Example 2

A black toner having a volume average toner diameter $d_{50}$ of 6.4 μm was obtained in the same manner as Example 6, except that crystalline compound (19) was replace with 4 parts by weight of comparative crystalline compound (paraffin wax having a melting peak temperature $t_{1m}$ of 139° C.; kneading conditions were controlled so that the temperature of melted raw materials was 132° C.; and cooling conditions were controlled so that the cooling time to reach $t_{1m}$−20° C. was 10 seconds. The obtained black toner was designated as "Comparative Black Toner 2".

Comparative Example 3

A black toner having a volume average toner diameter $d_{50}$ of 6.5 μm was obtained in the same manner as Example 6, except that crystalline compound (19) was replaced with 4 parts by weight of comparative crystalline compound (carnauba wax having a melting peak temperature $t_{1m}$ of 84° C.); kneading conditions were controlled so that the temperature of melted raw materials was 135° C.; and cooling conditions were controlled so that the cooling time to reach $t_{1m}$−44° C. was 20 seconds. The obtained black toner was designated as "Comparative Black Toner 3".

(Determination of Toner DSC Curves)

The DCS curve of each of Examples 1 through 6 as well as Comparative Examples 1 through 3 was determined. Based on the resultant DSC curve, obtained were the melting peak temperature $T_{1m}$ during the first heating process, the crystallization peak temperature $T_{1c}$, the glass transition temperature Tg during the second heating process, the recrystallization peak temperature $T_{rc}$, and the melting peak temperature $T_{2m}$. Table 2 shows all the results.

TABLE 2

| | Toner | | | | |
|---|---|---|---|---|---|
| | | Crystalline Compound | | | |
| | Type | Type | $t_{1m}$ (in ° C.) | Added Parts per 100 Parts of Resins | Production Method |
| Example 1 | Black 1 | (20) | 81 | 10 | polymerization method |
| Example 2 | Black 2B | (20) | 81 | 30 | polymerization method |
| Example 2 | Yellow 2Y | (20) | 81 | 30 | polymerization method |
| Example 2 | Magenta 2M | (20) | 81 | 30 | polymerization method |
| Example 2 | Cyan 2C | (20) | 81 | 30 | polymerization method |
| Example 3 | Black 3 | (21) | 78 | 10 | polymerization method |
| Example 4 | Black 4 | (22) | 76 | 10 | polymerization method |
| Example 5 | Black 5 | (3) | 73 | 10 | polymerization method |
| Example 6 | Black 6 | (20) | 81 | 4 | kneading method |
| Comparative Examples 1 | Comparative Black 1 | a | 139 | 4 | kneading method |
| Comparative Examples 2 | Comparative Black 2 | b | 93 | 4 | kneading method |
| Comparative Examples 3 | Comparative Black 3 | c | 84 | 4 | kneading method |

| | Toner | | | |
|---|---|---|---|---|
| | Maximum Temperature during Production (in ° C.) | Final Cooling Temperature (in ° C.) | Cooling Rate | Volume Average Particle Diameter $d_{50}$ (in $\mu$m) |
| Example 1 | 95(81 + 14) | 45(81 − 36) | 5° C./m | 6.5 |
| Example 2-B | 95(81 + 14) | 45(81 − 36) | 5° C./m | 6.4 |
| Example 2-Y | 95(81 + 14) | 45(81 − 36) | 5° C./m | 6.3 |
| Example 2-M | 95(81 + 14) | 45(81 − 36) | 5° C./m | 6.5 |
| Example 2-C | 95(81 + 14) | 45(81 − 36) | 5° C./m | 6.5 |
| Example 3 | 90(78 + 12) | 40(78 − 38 | 2° C./m | 6.6 |
| Example 4 | 85(76 + 9) | 45(76 − 31) | 5° C./m | 6.5 |
| Example 5 | 85(73 + 12) | 35(73 − 38) | 5° C./m | 6.4 |
| Example 6 | 136(81 + 55) | 45(81 − 36) | 4.6° C./s | 6.7 |
| Comparative Examples 1 | 145 | 100 | 4.5° C./s | 6.5 |
| Comparative Examples 2 | 132 | 73 | 2.0° C./s | 6.4 |
| Comparative Examples 3 | 135 | 40 | 4.8° C./s | 6.5 |

| | First Heating | First Cooling | Second Heating Process | | |
|---|---|---|---|---|---|
| | Process Melting Peak Temperature $T_{1m}$ (in ° C.) | Process Crystallization Peak Temperature $T_{1c}$ (in ° C.) | Glass Transition Temperature Tg (in ° C.) | Recrystal-lization Peak Temperature $T_{rc}$ (in ° C.) | Melting Peak Temperature $T_{2m}$ (in ° C.) |
| Example 1 | 80 | 57 | 54 | 74 | 82 |
| Example 2-B | 81 | 56 | 53 | 73 | 79 |
| Example 2-Y | 82 | 55 | 54 | 74 | 80 |
| Example 2-M | 80 | 57 | 53 | 74 | 80 |
| Example 2-C | 80 | 56 | 52 | 74 | 82 |
| Example 3 | 78 | 55 | 54 | 68 | 79 |
| Example 4 | 75 | 53 | 55 | 63 | 74 |
| Example 5 | 69 | 66 | 64 | 68 | 70 |
| Example 6 | 80 | 56 | 54 | 73 | 81 |
| Comparative Examples 1 | 140 | 102 | 57 | None | 141 |
| Comparative Examples 2 | 92 | 93 | 58 | None | 92 |
| Comparative Examples 3 | 83 | 73 | 62 | None | 80 |

<Fixing Devices>

Fixing Devices 1 through 3 having the following configuration were prepared.

(Fixing Device 1)

A fixing device installed in a "Konica 7050" electrophotographic copier, which was modified in such a manner that a cooling fan was installed at the exit of recording paper, and the oil coating mechanism as well as the heating roll cleaning mechanism was removed.

Fixing pressure: 235.2 kPa (2.4 kgf/cm$^2$)

Surface temperature of the heating roll: 198 to 201° C.

Nip passing time: 22 milliseconds (the nip width was 7.5 mm and the linear speed was 340 mm/second)

(Fixing Device 2)

A fixing device installed in a "Konica 2120" electrophotographic copier which was modified in such a manner that the fixing conditions described below were satisfied; a cooling fan was installed at the exit of recording paper; and the oil coating mechanism as well as the heating roll cleaning mechanism was removed.

Fixing pressure: 88.2 kPa (0.9 kgf/cm$^2$)

Surface temperature of the heating roll: 168 to 170° C.

Nip passing time: 41 milliseconds (the nip width was 4 mm and the linear speed was 105 mm/second)

(Fixing Device 3)

A trial fixing device which was prepared so as to satisfy the conditions described below and in which a cooling fan was not installed at the exit of recording paper, and neither the oil coating mechanism nor the heating roll cleaning mechanism was provided.

Fixing pressure: 98 kPa (0.9 kgf/cm$^2$)

Surface temperature of the heating roll: 179 to 181° C.

Nip passing time: 62 milliseconds (the nip width was 6.5 mm and the linear speed was 105 mm/second)

<Image Formation Employing Black Toners>

Developer 1, Developers 3 through 6, and Comparative Developers 1 through 3 were prepared by externally adding 0.5 percent by weight of fine hydrophobic silica particles and 0.7 percent by weight of fine hydrophobic titania particles to each of black toners obtained in Example 1, Examples 3 through 6, and Comparative Examples 1 through 3, followed by blending 5 parts by weight of the obtained toner with 95 parts by weight of a resin-coated magnetic ferrite carrier.

Each of developers obtained as described above was placed in a "Konica 7050" electrophotographic copier, and an electrostatically charged image formed on the electrostatic image bearing body was developed employing each of said black toners so that a toner image (consisting of 50×50 mm solid image and Color Test Chart No. 11 of Gazo Denshi Gakkai (Electronic Image Society)) was formed on said electrostatic image bearing body, and the resultant toner image was transferred to a recording paper (Konica 55 g paper), whereby the recording paper, on which an unfixed toner image was formed, was prepared.

Each of unfixed toner images which were formed on the recording paper, as described above, was heated and pressure fixed so as to form a fixed image while varying the type of the fixing device, the surface temperature Th of the heating roll, and the surface temperature Tp of the recording paper 3 seconds after passing the fixing nip. Incidentally, the surface temperature Tp of the recording paper was controlled by regulating the air flow rate of the cooling fan, installed at the exit of the recording paper, in accordance with Table 3 described below.

<Image Formation Employing Color Toner>

Fine titania particles were externally added to each of Black Toner 2B obtained in Example 2-B, Yellow Toner 2Y obtained Example 2-Y, Magenta Toner 2M obtained in Example 2-M, and Cyan Toner 2C obtained in Example 2C so as to obtain 2 percent by weight. Subsequently, each of Developer 2B, Developer 2Y, Developer 2M, and Developer 2C was prepared by blending 5 parts by weight of each of the resultant toners with 95 parts by weight of a resin coated magnetic ferrite carrier.

Each of the developers obtained as described above was placed in a "Konica 7823" color copier and, an electrostatically charged image formed, on the electrostatic image bearing body, was developed employing a toner so that a toner image (consisting of a 50×50 mm solid image and Color Test Chart No. 11 of Gazo Denshi Gakkai (Electronic Image Society)) was formed on said electrostatic image bearing body, and the resultant toner image was transferred to recording paper (Konica 55 g paper), whereby the recording paper, on which an unfixed toner image was formed, was prepared.

Each of said unfixed toner images, which were formed on the recording paper as described above, was thermally pressure fixed employing Fixing Device 3 so as to form fixed images, while varying the surface temperature Th of the heating roll, and the surface temperature Tp of the recording paper 3 seconds after passing the fixing nip in accordance with Table 3 described below. Further, the surface temperature Tp of the recording paper was controlled by regulating the airflow rate of the cooling fan installed at the exit of the recording paper in accordance with Table 3 described below.

<Evaluation of Fixed Images>

The damage resistance (abrasion resistance, scratch resistance, and dent resistance) and the fixed strength of each image, formed as described above, were evaluated. Evaluation methods were as follows. Table 3 shows the results.

(1) Abrasion Resistance

Each of the fixed images was abraded by 15 back-and-forth motions under an application of pressure of 2.156 kPa (22 gf/cm$^2$), employing Konica 55 g paper. The resulting abrasion on the abraded image was visually evaluated. The evaluation criteria were as follows:

A: no abrasion is observed on the solid image area as well as the Color Test Chart area B: slight abrasion is observed in only a small part of the solid image area C: some abrasion is observed in the solid image area, but abrasion is not clearly observed in the Color Test Chart area D: marked abrasion was observed in the solid image area and abrasion was clearly observed in the Color Test Chart are.

"A" as well as "B" was judged to be commercially viable.

(2) Scratch Resistance

The tip of an uninked ball-point pen (Stainless Tip manufactured by Zebra) was brought into contact with a solid image area under an application of its own weight and was allowed to run on the solid image area in said state. The tip running surface was then visually observed and the generation of scratches (scratched trail) was evaluated. The evaluation criteria were as follows:

A: no scratched trail is observed
B: a scratched trail is slightly observed
C: a line is faintly observed when the image is viewed just above the position, but is not clearly observed when the image is viewed at an angle of 45 degrees
D: a line is clearly observed when the image is viewed just above the position.

"A" as well as "B" was judged to be commercially viable.

(3) Dent Resistance

A solid image area was pressed employing the tip of said ball-point pen (under a pressing load of 100 g for a pressing time of 5 seconds), and the pressed part was visually observed. The generation of dents was then evaluated. The evaluation criteria were as follows:

A: no dent is observed
B: a dent is slightly observed
C: a dent is faintly observed when the image is viewed just above the position, but is not clearly observed when the image was viewed at an angle of 45 degrees
D: a dent is clearly observed when the image is viewed just above the position "A" as well as "B" was judged to be commercially viable.

(4) Fixed Strength

A fixed image was abraded under the same conditions as the method for evaluating the abrasion resistance, except that the reflection density of the solid black area was changed t 1.0. The ratio of the reflection density after abrasion to the reflection density prior to abrasion was designated as the fixed strength.

TABLE 3

| Developer | Toner | Crystalline Compound Type | Crystalline Compound $t_{rc}$ (in ° C.) | Fixing Device | Surface Temperature of Heating Roll Th (in ° C.) | Temperature of Recording Paper 3 Seconds after Passing the Nip Tp (in ° C.) |
|---|---|---|---|---|---|---|
| Developer 1 | Black 1 | (20) | 76 | 1 | 198 | 42 |
| Developer 2B | Black 2B | (20) | 76 | 3 | 180 | 39 |
| Developer 2Y | Yellow 2Y | (20) | 76 | 3 | 181 | 44 |
| Developer 2M | Magenta 2M | (20) | 76 | 3 | 180 | 44 |
| Developer 2C | Cyan 2C | (20) | 76 | 3 | 179 | 45 |
| Developer 3 | Black 3 | (21) | 70 | 1 | 200 | 47 |
| Developer 4 | Black 4 | (22) | 65 | 1 | 201 | 52 |
| Developer 5 | Black 5 | (3) | 69 | 2 | 170 | 63 |
| Developer 6 | Black 6 | (20) | 76 | 2 | 170 | 79 |
| Comparative Developer 1 | Comparative Black 1 | a | none | 2 | 170 | 83 |
| Comparative Developer 2 | Comparative Black 2 | b | none | 2 | 168 | 88 |
| Comparative Developer 3 | Comparative Black 3 | c | none | 2 | 169 | 83 |

| Developer | Temperature Difference (Th − Tp) (in ° C.) | Damage Resistance: Abrasion Resistance | Damage Resistance: Scratch Resistance | Damage Resistance: Dent Resistance | Fixed Strength (in %) |
|---|---|---|---|---|---|
| Developer 1 | 156 | A | A | A | 99.3 |
| Developer 2B | 141 | A | A | A | 99.0 |
| Developer 2Y | 137 | A | A | A | 99.2 |
| Developer 2M | 136 | A | A | A | 99.4 |
| Developer 2C | 134 | A | A | A | 98.9 |
| Developer 3 | 153 | A | A | B | 97.5 |
| Developer 4 | 149 | B | A | A | 97.9 |
| Developer 5 | 107 | B | B | B | 96.0 |
| Developer 6 | 91 | C-B | B | B | 97.0 |
| Comparative Developer 1 | 87 | D | D | D | 90.3 |
| Comparative Developer 2 | 80 | C | D | D | 94.1 |
| Comparative Developer 3 | 86 | C | D | D | 92.2 |

Example 7

A black toner was produced in the same manner as Example 1, except that during the synthesis process of the low molecular weight latex, crystalline compound (19) was replaced with 66.7 g of crystalline compound (29) (diglycerol tribehenic acid ester); during the synthesis process of the high molecular weight latex, crystalline compound (19) was replaced with 13.34 g of crystalline compound (29) (diglycerol tribehenic acid); the interior temperature during production of the toner was varied to 87° C. ($t_{1m}$+14° C.); and cooling was carried out to 35° C. ($t_{1m}$−38° C.) at a rate of 5° C./minute. The obtained toner was designated as "Black Toner 7". The particle diameter of Black Toner 7 was determined employing a Coulter Counter II (manufactured by Coulter Co.), resulting in a volume average particle diameter $d_{50}$ of 6.5 μm and a variation coefficient CV of 18.2 percent.

Example 8

A black toner was produced in the same manner as Example 1, except that during the synthesis process of the low molecular weight latex, crystalline compound (19) was replaced with 66.7 g of crystalline compound (44) (dipentaerythritolhexabehenic acid ester); during the synthesis process of the high molecular weight latex, crystalline compound (19) was replaced with 13.34 g of crystalline compound (44) (dipentaerythritolhexabehenic acid ester); the interior temperature during production of the toner was varied to 95° C. ($t_{1m}$=14° C.); and cooling was carried out to 45° C.($t_{1m}$−36° C.) at a rate of 5° C./minute. The obtained toner was designated as "Black Toner 8". The particle diameter of Black Toner 7 was determined employing a Coulter Counter II (manufactured by Coulter Co.), resulting in a volume average particle diameter $d_{50}$ of 6.5 μm and a variation coefficient CV of 18.7 percent.

TABLE 4

| | Toner | | | | |
|---|---|---|---|---|---|
| | | Crystalline Compound | | | |
| | Type | Type | $t_{1m}$ (in ° C.) | Added Parts per 100 Parts of Resins | Production Method |
| Example 1 | Black 1 | (19) | 81 | 10 | polymerization method |
| Example 2 | Black 2B | (19) | 81 | 30 | polymerization method |
| Example 2 | Yellow 2Y | (19) | 81 | 30 | polymerization method |
| Example 2 | Magenta 2M | (19) | 81 | 30 | polymerization method |
| Example 2 | Cyan 2C | (19) | 81 | 30 | polymerization method |
| Example 3 | Black 3 | (20) | 78 | 10 | polymerization method |
| Example 4 | Black 4 | (21) | 76 | 10 | polymerization method |
| Example 5 | Black 5 | (3) | 73 | 10 | polymerization method |
| Example 6 | Black 6 | (19) | 81 | 4 | kneading method |
| Example 7 | Black 7 | (29) | 73 | 10 | polymerization method |
| Example 8 | Black 8 | (44) | 81 | 10 | polymerization method |
| Comparative Examples 1 | Comparative Black 1 | a | 139 | 4 | kneading method |
| Comparative Examples 2 | Comparative Black 2 | b | 93 | 4 | kneading method |
| Comparative Examples 3 | Comparative Black 3 | c | 84 | 4 | kneading method |

| | Toner | | | |
|---|---|---|---|---|
| | Maximum Temperature during Production (in ° C.) | Final Cooling Temperature (in ° C.) | Cooling Rate | Volume Average Particle Diameter $d_{50}$ (in μm) |
| Example 1 | 95(81 + 14) | 45(81 − 36) | 5° C./m | 6.5 |
| Example 2-B | 95(81 + 14) | 45(81 − 36) | 5° C./m | 6.4 |
| Example 2-Y | 95(81 + 14) | 45(81 − 36) | 5° C./m | 6.3 |
| Example 2-M | 95(81 + 14) | 45(81 − 36) | 5° C./m | 6.5 |
| Example 2-C | 95(81 + 14) | 45(81 − 36) | 5° C./m | 6.5 |
| Example 3 | 90(78 + 12) | 40(78 − 38 | 2° C./m | 6.6 |
| Example 4 | 85(76 + 9) | 45(76 − 31) | 5° C./m | 6.5 |
| Example 5 | 85(73 + 12) | 35(73 − 38) | 5° C./m | 6.4 |
| Example 6 | 136(81 + 55) | 45(81 − 36) | 4.6° C./m | 6.7 |
| Example 7 | 87(73 + 14) | 35(73 − 38) | 5° C./m | 6.5 |
| Example 8 | 95(81 + 14) | 45(81 − 36) | 5° C./m | 6.5 |
| Comparative Examples 1 | 145 | 100 | 4.5° C./s | 6.5 |
| Comparative Examples 2 | 132 | 73 | 2.0° C./s | 6.4 |
| Comparative Examples 3 | 135 | 40 | 4.8° C./s | 6.5 |

| | First Heating | First Cooling | Second Heating Process |
|---|---|---|---|

TABLE 4-continued

| | Process Melting Peak Temperature $T_{1m}$ (in ° C.) | Process Crystallization Peak Temperature $T_{1c}$ (in ° C.) | Glass Transition Temperature Tg (in ° C.) | Recrystal-lization Peak Temperature $T_{rc}$ (in ° C.) | Melting Peak Temperature $T_{2m}$ (in ° C.) |
|---|---|---|---|---|---|
| Example 1 | 80 | 57 | 54 | 74 | 82 |
| Example 2-B | 81 | 56 | 53 | 73 | 79 |
| Example 2-Y | 82 | 55 | 54 | 74 | 80 |
| Example 2-M | 80 | 57 | 53 | 74 | 80 |
| Example 2-C | 80 | 56 | 52 | 74 | 82 |
| Example 3 | 78 | 55 | 54 | 68 | 79 |
| Example 4 | 75 | 53 | 55 | 63 | 74 |
| Example 5 | 69 | 66 | 64 | 68 | 70 |
| Example 6 | 80 | 56 | 54 | 73 | 81 |
| Example 7 | 75 | 53 | 54 | 63 | 74 |
| Example 8 | 80 | 57 | 54 | 73 | 81 |
| Comparative Examples 1 | 140 | 102 | 57 | None | 141 |
| Comparative Examples 2 | 92 | 93 | 58 | None | 92 |
| Comparative Examples 3 | 83 | 73 | 62 | None | 80 |

TABLE 5

| | | Crystalline Compound | | | Surface Temperature of Heating | Temperature of Recording Paper 3 Seconds after |
|---|---|---|---|---|---|---|
| Developer | Toner | Type | $t_{rc}$ (in ° C.) | Fixing Device | Roll Th (in ° C.) | Passing the Nip Tp (in ° C.) |
| Developer 1 | Black 1 | (19) | 76 | 1 | 198 | 42 |
| Developer 2B | Black 2B | (19) | 76 | 3 | 180 | 39 |
| Developer 2Y | Yellow 2Y | (19) | 76 | 3 | 181 | 44 |
| Developer 2M | Magenta 2M | (19) | 76 | 3 | 180 | 44 |
| Developer 2C | Cyan 2C | (19) | 76 | 3 | 179 | 45 |
| Developer 3 | Black 3 | (20) | 70 | 1 | 200 | 47 |
| Developer 4 | Black 4 | (21) | 65 | 1 | 201 | 52 |
| Developer 5 | Black 5 | (3) | 69 | 2 | 170 | 63 |
| Developer 6 | Black 6 | (19) | 76 | 2 | 170 | 79 |
| Developer 7 | Black 7 | (29) | 69 | 1 | 196 | 41 |
| Developer 8 | Black 8 | (44) | 75 | 1 | 200 | 44 |
| Comparative Developer 1 | Comparative Black 1 | a | none | 2 | 170 | 83 |
| Comparative Developer 2 | Comparative Black 2 | b | none | 2 | 168 | 88 |
| Comparative Developer 3 | Comparative Black 3 | c | none | 2 | 169 | 83 |

| | Temperature Difference | Damage Resistance | | | Fixed |
|---|---|---|---|---|---|
| Developer | (Th − Tp) (in ° C.) | Abrasion Resistance | Scratch Resistance | Dent Resistance | Strength (in %) |
| Developer 1 | 156 | A | A | A | 99.3 |
| Developer 2B | 141 | A | A | A | 99.0 |
| Developer 2Y | 137 | A | A | A | 99.2 |
| Developer 2M | 136 | A | A | A | 99.4 |
| Developer 2C | 134 | A | A | A | 98.9 |
| Developer 3 | 153 | A | A | B | 97.5 |
| Developer 4 | 149 | B | A | A | 97.9 |
| Developer 5 | 107 | B | B | B | 96.0 |
| Developer 6 | 91 | C-B | B | B | 97.0 |
| Developer 7 | 155 | A | A | A | 98.9 |

TABLE 5-continued

| | | | | | |
|---|---|---|---|---|---|
| Developer 8 | 156 | A | A | A | 99.1 |
| Comparative Developer 1 | 87 | D | D | D | 90.3 |
| Comparative Developer 2 | 80 | C | D | D | 94.1 |
| Comparative Developer 3 | 86 | C | D | D | 92.2 |

When the toner of the present invention is utilized, it is possible to provide excellent damage resistance (abrasion resistance, scratch resistance, and dent resistance) to formed fixed images.

When the production method of the present invention is utilized, it is possible to securely produce a toner which provides excellent damage resistance of fixed images.

When the image forming method of the present invention is utilized, it is possible to form fixed images which exhibit excellent damage resistance.

What is claimed is:

1. A toner for developing electrostatic latent image comprising a binder resin and a coolant, wherein the toner comprises a crystalline compound, and exhibits at least one recrystallization peak in a second heating process on the DSC curve of said toner, and wherein the crystalline compound is that represented by formula (1), $$(1):\ R^1—(OCO—R^2)_n$$

wherein $R^1$ represents a hydrocarbon group having from 1 to 80 carbon atoms, which may have a substituent, or a group represented by formula of $(LK_1—X—LK_2)_m$-, wherein $LK_1$ and $LK_2$ represent a hydrocarbon group, which may have a substituent, and $LK_1$ and $LK_2$ may be same or different, m is a natural number of 1 or more, X represents O or —OCO—, $R^2$ represents a hydrocarbon group having from 1 to 80 carbon atoms, which may have a substituent, and n represents an integer of 1 to 15.

2. The toner of claim 1, wherein the toner comprises the crystalline compound in an amount of 3 to 40 parts by weight per 100 parts by weight of said binder resin.

3.

4. The toner of claim 3, wherein $R^1$ and $R^2$ each represents a hydrocarbon group.

5. The toner of claim 1, wherein the toner is comprised of particles obtained by directly polymerizing a monomer composition comprising said crystalline compound and a polymerizable monomer in a water phase.

6. The toner of claim 1, wherein the toner is comprised of particles obtained by coalescing fine particles which are obtained by direct polymerization of a monomer composition comprising said crystalline compound and a polymerizable monomer in a water phase.

7. The toner of claim 1, wherein said crystalline compound has penetration number of not more than 5 determined at a temperature of 50° C. at a load of 150 g.

8. The toner of claim 1, wherein said crystalline compound has penetration number of not more than 2 determined at a temperature of 50° C. at a load of 150 g.

9. The toner of claim 1, wherein the binder resin is styrene-acrylic copolymers or styrene-butadiene copolymers.

10. The toner of claim 1, wherein a content of the crystalline compound is 5 to 35 parts by weight with respect to 100 parts by weight of the binder resin.

11. The toner of claim 4, wherein said crystalline compound has penetration number of not more than 5 determined at a temperature of 50° C. at a load of 150 g, the binder resin is styrene-acrylic copolymers or styrene-butadiene copolymer, and a content of the crystalline compound is 5 and 35 parts by weight with respect to 100 parts by weight of the binder resin.

12. The toner of claim 4, wherein said crystalline compound has recrystallization peak temperature $t_{rc}$ between on-set temperature $t_{20}$ and melting peak temperature $t_{2m}$ during the second heating temperature.

13. The toner of claim 12, wherein the recrystallization peak temperature $t_{rc}$ is between ($t_{20}$+5° C.) and ($t_{2m}$−2° C.).

14. The toner of claim 12, wherein crystallization peak temperature $t_{1c}$ during the first cooling process is 10 to 30° C. lower than melting peak temperature $t_{1m}$ during the first heating process in the DSC curve of the crystalline compound.

15. An image forming method comprising developing electrostatically charged image formed on an electrostatic image bearing body employing a toner; transferring the resultant toner image formed on said electrostatic image bearing body onto an image support; and fixing the transferred toner image on the image support by thermally pressure employing a heating roller; wherein the toner is that claimed in claim 1.

16. The image forming method of claim 15, wherein a temperature of surface of the heating roller is not less than $t_{rc}$, surface temperature of the image support 3 seconds after passing the fixing nip roll is at least 90° C. lower than the surface temperature of said heating roll.

* * * * *